US009343210B2

(12) United States Patent
Adar et al.

(10) Patent No.: US 9,343,210 B2
(45) Date of Patent: May 17, 2016

(54) THREE-PHASE MAGNETIC CORES FOR MAGNETIC INDUCTION DEVICES AND METHODS FOR MANUFACTURING THEM

(71) Applicant: U.T.T. UNIQUE TRANSFORMER TECHNOLOGIES LTD, Or Akiva (IL)

(72) Inventors: Eliezer Adar, Herev La Et (IL); Yuri Bolotinsky, Netanya (IL)

(73) Assignee: U.T.T. UNIQUE TRANSFORMER TECHNOLOGIES LTD (IL)

( * ) Notice: Subject to any disclaimer, the term of this patent is extended or adjusted under 35 U.S.C. 154(b) by 120 days.

(21) Appl. No.: 14/372,828

(22) PCT Filed: Jan. 15, 2013

(86) PCT No.: PCT/IL2013/050037
§ 371 (c)(1),
(2) Date: Jul. 17, 2014

(87) PCT Pub. No.: WO2013/108247
PCT Pub. Date: Jul. 25, 2013

(65) Prior Publication Data

US 2014/0354386 A1 Dec. 4, 2014

(30) Foreign Application Priority Data

Jan. 17, 2012 (IL) ..... 217576

(51) Int. Cl.
*H01F 30/12* (2006.01)
*H01F 30/14* (2006.01)
(Continued)

(52) U.S. Cl.
CPC ..... *H01F 3/04* (2013.01); *H01F 1/15333* (2013.01); *H01F 27/25* (2013.01); *H01F 30/12* (2013.01); *H01F 41/022* (2013.01); *H01F 41/0213* (2013.01); *Y10T 29/49071* (2015.01); *Y10T 29/49075* (2015.01)

(58) Field of Classification Search
CPC ..... H01F 30/12; H01F 29/10; H01F 27/245; H01F 27/25; H01F 41/041
USPC ..... 336/5, 10, 12, 212, 213, 214, 215, 234; 29/602.1
See application file for complete search history.

(56) References Cited

U.S. PATENT DOCUMENTS 2,401,952 A * 6/1946 Mayberry ..... H01F 30/12 336/213
5,202,664 A * 4/1993 Poulsen ..... H01F 27/324 336/213

(Continued)

FOREIGN PATENT DOCUMENTS

EP 2395521 A1 12/2011
WO 2010027290 A1 3/2010

OTHER PUBLICATIONS

International Preliminary Report on Patentability issued Feb. 12, 2014 re: PCT/IL2013/050037; pp. 17.

(Continued)

*Primary Examiner* — Tsz Chan
(74) *Attorney, Agent, or Firm* — Cantor Colburn LLP

(57) ABSTRACT

Three-phase magnetic cores for magnetic induction devices (e.g., transformers, coils, chokes), and methods for manufacturing them, are disclosed. The magnetic cores are generally constructed from three generally rectangular magnetic core frames having a stair-stepped configuration extending along side portions of the frames. The frames are arranged to form a triangular prism structure such that side portions of locally adjacent frames are uniformly engaged to form three core legs over which coils of a three-phase magnetic induction device may be placed.

21 Claims, 11 Drawing Sheets

(51) Int. Cl.

| | |
|---|---|
| ***H01F 27/24*** | (2006.01) |
| ***H01F 7/06*** | (2006.01) |
| ***H01F 3/04*** | (2006.01) |
| ***H01F 27/25*** | (2006.01) |
| ***H01F 41/02*** | (2006.01) |
| ***H01F 1/153*** | (2006.01) |

(56) References Cited

U.S. PATENT DOCUMENTS 6,668,444 B2 * 12/2003 Ngo ..... H01F 27/25 29/602.1
6,683,524 B1 * 1/2004 Hoglund ..... H01F 27/25 336/212
6,809,620 B2 10/2004 Hoglund
2003/0090355 A1 * 5/2003 Hoglund ..... H01F 3/06 336/213
2010/0194515 A1 * 8/2010 Hurst ..... H01F 27/23 336/212
2011/0109412 A1 * 5/2011 Vollrath ..... H01F 27/263 336/12

OTHER PUBLICATIONS

International Search Report issued Apr. 23, 2013 re: PCT/IL2013/050037.

* cited by examiner

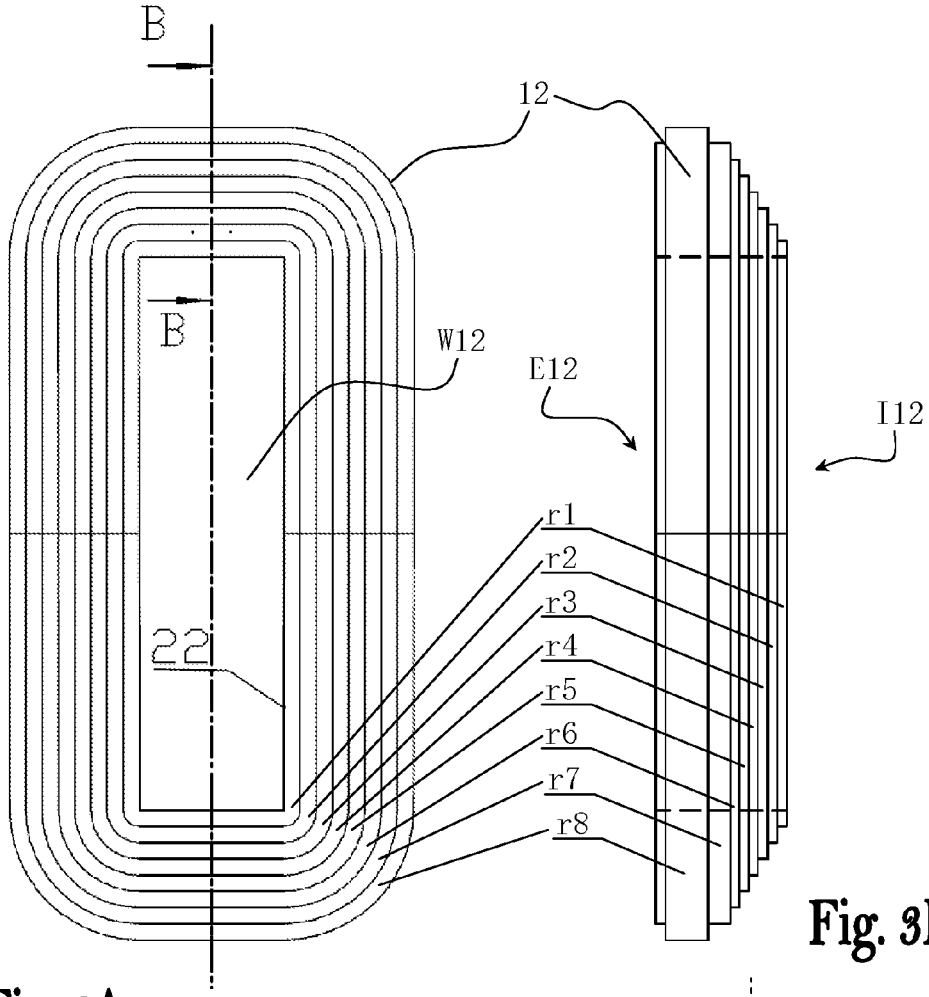
Fig. 3A
Fig. 3B
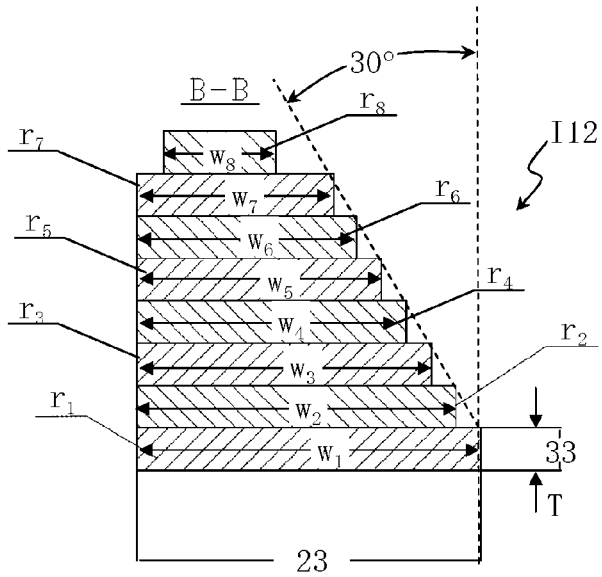
Fig. 3C

THREE-PHASE MAGNETIC CORES FOR MAGNETIC INDUCTION DEVICES AND METHODS FOR MANUFACTURING THEM

TECHNOLOGICAL FIELD

The invention relates to three-phase magnetic induction devices, to magnetic circuit cores used in such devices, and to methods for manufacturing them.

BACKGROUND

Magnetic induction devices (e.g., electrical transformers, chokes, and suchlike) are designed to transfer electrical energy between inductively coupled wound conductors (coils) based on the mutual induction effect. For example, in electrical transformers the alternating electrical current supplied to a primary winding inductively coupled to the transformer' core creates a magnetic flux in the core which induces electric motive force (EMF) or voltage in a secondary winding inductively coupled to the transformer' core.

A three-phase transformer typically comprises a magnetic-core circuit and three coil blocks inductively coupled to the magnetic-core circuit. Each one of the coil blocks usually consists of primary and secondary windings. State of the art three-phase electrical transformers usually utilize the so called "E+1" magnetic core configuration (where coils are mounted over the three legs of the "E"-shaped frame of the magnetic core that is thereafter closed by the "1"-shaped yoke of the core). The "E+1" magnetic core configuration provides a planar core structure, comprised of several interconnected magnetic core yoke and leg elements geometrically arranged in a single plane.

For example, U.S. Pat. No. 6,668,444 discloses a three-phase transformer having a flat magnetic core configuration made from an amorphous metal strip. This flat magnetic core configuration utilizes "stair-stepped" joints designed to facilitate the opening of the core legs for lacing coils over them, and thereafter closing the joints to thereby close the magnetic core circuit. This manufacturing technique however provides a flat magnetic-core structure which is less efficient for magnetic flux distribution, requires complex technologies of magnetic circuit closure, and results in substantially high weight magnetic cores. In particular, it is impossible to resolve the problem of asymmetrical magnetic flux distribution in such flat magnetic-core structures of these flat transformer configurations.

Possible alternatives to the flat three-phase transformer configurations are the triangular type magnetic-core magnetic systems. For example, U.S. Pat. No. 6,683,524 discloses a three-phase transformer having a triangular (delta) structure. In this solution the transformer core is made of three frames, each comprising several rings wound from a strip of magnetic material of constant width. The frames are assembled into a core such that two triangular yoke structures are formed having vertical legs extending between of their corners, wherein the legs are formed from the wound rings which are slid over, offset or splayed one relative to the other. This configuration provides transformer legs having a polygonal cross-section shape, but it is however very complex to manufacture, and its structural configuration increases the magnetic losses.

US Patent publication No. 2010/0194515 describes a triangular three-phase transformer constructed from three frames which are assembled to construct hexagonal legs (also known as 'hexaformer') employing tapered rings structures obtained using an off-set wound technique. It is suggested in this publication to fabricate the core frames partly from wound amorphous ribbon and partly from electrical steel, which is extremely difficult because these materials have different thicknesses, different mechanical strengths and require different effort tensions during winding. Therefore, such construction of the frames does not provide a high winding density, which is one of the main parameters of the magnetic system. Furthermore, the use of such hybrid core frames increases load losses due to increased magnetic losses in electrical steel compared to amorphous materials. This publication further suggests mechanically stretching the core frames, which is very problematic since the required efforts are determined by the volume of the electrical steel used in the frames. Furthermore, the simultaneous displacement of the amorphous ribbon and electrical steel by these efforts is prone to breakage of the amorphous metal ribbon, which in turn will lead to an increase in no-load current.

European patent publication No. EP 2,395,521 discloses a method for manufacture of triangular transformer cores made of amorphous metal ribbon, wherein the legs of the magnetic core are arranged in a triangular configuration where the cross-section of the core legs has a circular or polygonal shape. In order to obtain the required cross-sectional shape of the legs the core frames are constructed from layers of continuously wound band, where the width of the bands is adjusted according to the respective layer of the core leg by means of laser cutting. However, molten material that is typically formed during such laser cutting of amorphous ribbon, results in stark molten drops of ribbon material formed along the cutting edges which causes gaps between the layers of the magnetic ribbons during their winding. In addition, such stark molten drops may also create conditions for the occurrence of short circuits in the operation of the magnetic system. It is noted that such a method of manufacturing the magnetic core with variable cross sections is very complex and problematic to realize.

U.S. Pat. No. 6,809,620 discloses three-phase transformers having a triangular cage core structure assembled from three frames. The three frames assembly form triangular yoke structures whose corners are connected by three legs, where the core frames are wound from a plurality of strips, each of the strips being offset from adjacent strips to obtain rhomboidal cross-section of the frames. The magnetic core is made from interleaved ring structures made of wires or strips of magnetic material, wherein each of the rings makes up part of two of the legs. However, the interleaved rings structure suggested in this patent necessitate very complex production technology, in particular for manufacture of power transformers.

GENERAL DESCRIPTION

The present invention generally concerns three-phase magnetic cores for magnetic induction devices (e.g., transformers, chokes) comprising three generally rectangular magnetic core frames, i.e., having side portions and yoke portions. The frames are arranged in a substantially triangular prism (pentahedron) configuration, each of the frames having a stair-stepped configuration along either one or both of the internal and external surfaces of the side portion. The side portions of two locally adjacent frames are engaged to form a leg over which a coil may be placed. Thus, the entire core has three legs formed by uniformly engaged adjacent frames, over which three coils of a three-phase magnetic induction device may be placed.

The magnetic core frame is generally of a spatial shape. As indicated above, either one of the internal and external surfaces of the side portion of the frame may have the stair-stepped configuration forming a respective projecting face (e.g., internal face), while the other surface may have a similar configuration (external face) or may be flat or curved or any other suitable shape per design requirements. The magnetic core is typically assembled from three such magnetic core frames adjacently situated one next to the other (i.e., locally adjacent) such that stair-stepped side portions of locally adjacent frames uniformly engage to form the core legs.

The above configuration defining stair-stepped projecting faces along the side portions of the frames provides tight and uniform engagement between the adjacent frames (i.e., along the leg portions of the magnetic core). This configuration further provides for optimal match between the geometry/shape (e.g., circular or polygonal) of the outer surface of the leg (defined by the engaged side portions of the frames) and that of the internal surface of a corresponding coil which is to be placed over the core legs. This provides optimal (maximal) cross-sectional occupation of the magnetic core material of the leg portions along regions thereof carrying/facing the coils, thereby improving efficiency and various core properties, such as, reduced geometrical dimensions, and reduction in the amount of magnetic core material and weight, etc.

For example, in some embodiments the stair-stepped configuration utilizes an arrangement/array of steps having a pitch of about 30°, and the frames are oriented with a 60° angle relative to one another, to thereby form a polygonal shape (e.g., triangular prism pentahedron) i.e., wherein an equilateral triangular geometry of the upper/bottom bases is defined by yoke portions.

One or more of the core frames may be fabricated from a plurality of multilayered loops made of magnetic ribbons. The core frame may be formed from a plurality of magnetic ribbons of different widths, each ribbon is wound to form a multilayered loop, where the wound loops are wound one over the other to form the stair-stepped face(s). Alternatively, the multilayered loops may be separately prepared, each from a wound magnetic ribbon, and the core frames may be prepared by coaxially stacking the loops one on top of the other, to form the desired stair-stepped configuration of the core frames.

In some embodiments the magnetic core frames are constructed by successively winding magnetic material ribbons to form multilayered loops arranged one over the other using for successive multilayered loops magnetic material ribbons having successively decreasing or increasing widths. For example, each multilayered loop may be prepared by winding a magnetic ribbon having a predetermined length and width, and the turns of each ribbon are substantially aligned one on top of the other to thereby form a single step of the stair-stepped configuration, said step having a step thickness defined by the number of ribbon turns. In this way, the magnetic ribbons of the loops may be wound one over the other in a descending order of their thicknesses to thereby obtain the desired stair-stepped configuration of at least the inner face of the frame. Accordingly, in this example, the innermost multilayered loop is wound from a ribbon having the greatest width and the outermost multilayered loop is wound from a ribbon having the smallest width.

In some embodiments the magnetic core frames are constructed by successively winding at least some magnetic material ribbons one over the other in an ascending order of the ribbon widths, and then winding thereover at least some other magnetic material ribbons one over the other in a descending order of their widths. In this way the leg portions of the magnetic frames may be configured to assume the stair-stepped configuration on one (the internal) face of the frames, and a curved cross-sectional shape at the other (the external) face of the frames. This configuration of the leg portions of the frames provides a curved (e.g., the curve circumscribing the cross section of the magnetic core leg is circular in shape) cross-sectional shape of the core legs obtained by engaging the stair-stepped side portions of the frames to construct the triangular prism core structure.

Alternatively, one or more magnetic core frames may be assembled from a plurality of multilayered loops, each one of the loops being fabricated from a magnetic material ribbon separately wound to produce a multilayered loop having a predefined loop width (e.g., defined by the number of turns in the loop) and predefined central opening. Each multilayered loop may be prepared from a magnetic ribbon having a predetermined length and width, where the thickness of the loop (step) is defined by the ribbon width, and the turns of each loop are aligned one over the other to thereby obtain loop faces that are substantially flat. In such implementations the multilayered loops are coaxially stacked one on top of the other (i.e., having the flat faces of adjacent loops in abutting relationship) with respect to their loop widths to thereby obtain a desired stair-stepped configuration of at least one (the internal) face of the frame, while defining a central window by the coaxial arrangement of the central openings of the stacked loops. The dimensions of the central openings of the frames may be adjusted to accommodate the coils of the three-phase magnetic induction device, that are to be placed over the legs of the magnetic core constructed by the frames.

For example, in possible embodiments the multilayered loops may be stacked one on top of the other in a descending order of their loop widths, to thereby obtain the desired stair-stepped configuration of the internal face of the frames. In this case, the bottommost multilayered loop (e.g., at the external face of the frame) is the loop having the greatest loop width and the uppermost loop is the loop having the smallest loop width (e.g., at the internal face of the frame).

The magnetic material ribbons are preferably wound to form rectangular loop structures such that a central opening is formed in each multilayered loop, and the loops of each frame are so arranged to coaxially align the central openings of the loops to thereby form a central rectangular window in the frame. The central windows of the core frames are configured to accommodate coil elements of the magnetic induction device that are placed at a later stage of the process over magnetic core legs formed by the engaged side leg portions of locally adjacent situated magnetic core frames.

In possible embodiments at least some of the loops may have different dimensions of their central openings, which may be employed to design magnetic core frames having curved cross sectional shapes. For example, the multilayered loops may be coaxially stacked one on top of the other in an ascending order of their loop widths with respect to the dimensions of the their central openings, and some other multilayered loops may be coaxially stacked thereover (also one on top of the other) in a descending order of their loop widths with respect to the dimensions of their central openings, to thereby obtain a stair-stepped configuration of the internal face of the frame and a curved cross-sectional shape of the external and/or medial sides of the leg portions of the frames.

In possible applications the magnetic core frames may be constructed by combining the above described loop winding and stacking techniques. For example, one or more magnetic core frames may be fabricated by successively winding some of the multilayered loops one over the other, and then coaxially stacking thereover one or more separately prepared multilayered loops (i.e., on top of the wound loops).

In some possible embodiments the magnetic core frames of the magnetic core circuit are made of an amorphous metal ribbon e.g., produced from soft ferromagnetic amorphous alloy, or from nanocrystalline alloys, e.g., for high frequency transformers. Alternatively, the magnetic core frames are made of a thin ribbon of silicon steel.

In some embodiments the coil elements are placed over the magnetic core legs by transversally cutting a portion of the magnetic core frames to obtain upper and bottom frame portions of each frame, assembling the bottom frame portions to form a triangular structure (i.e., of the yokes) by engaging their stair-stepped leg portions, thereby forming the bottom parts of the core legs, placing over the bottom parts of the core legs coils, and thereafter attaching the upper portion of the frames on top of their respective bottom portions to restore the rectangular structure of the frames.

According to possible embodiments the multiphase magnetic induction device, may be fabricated as follows:

- preparing the magnetic core frames, each one of the frames comprised of a plurality of multilayered loops made from wound magnetic material ribbons (e.g., having soft ferromagnetic properties), the multilayered loops are arranged to form a stair-stepped configuration in at least one face of the core frames;
- if the frames are made from amorphous ribbon, optionally applying a thermal treatment to the magnetic core frames (e.g., annealing at temperatures of about 360 to 400° C., which may be followed by slow gradual cooling of the frames in the annealing oven);
- impregnating the frames in an organic binding material (e.g., organo-silicon lacquer or epoxy varnish), followed by drying of the frames;
- transversally cutting the frames to upper and bottom parts;
- vertically mounting the bottom parts of the frames on a basis of the device (e.g., made from an electrically insulated material) by placing said parts one adjacent to the other in a triangular form, such that stair-stepped side portions of the legs of the bottom parts of the frames become engaged;
- mounting coil blocks on each pair of engaged leg portions of the bottom frame parts;
- mounting vertically the three corresponding upper parts of the magnetic core frames to restore the rectangular shape of the frames;
- applying an electrically insulating material between the engaged leg portions of the frames;
- mounting an upper clamping plate (e.g., made from an electrically insulating material); and
- electrically connecting leading-out wires and securing the device with draw studs.

The techniques of the present application provide various advantages. For example, the stair-stepped configuration of the frames of the magnetic core employing multilayered rectangular loops can be effectively designed to assume a desired cross-section shape (e.g., of circular perimeter or polygonal shape) of the magnetic core leg of each phase and allows reaching minimum no-load losses. Additionally, the modular structure of the magnetic core of the device simplifies its assembly and dismantling, thereby allowing easy manufacture and maintenance of the device. Configuring the core legs to assume a desired cross-sectional shape provides for efficient filling of the cross-section area of the core surrounded by the coils with magnetic material of the legs, thereby decreasing the diameter and weight of the coils, and correspondingly, decreasing electrical losses in the coils.

The design of the magnetic induction device disclosed herein requires less ribbon material to fabricate, provides lighter transformer magnetic cores, and improves efficiency of the device. In particular, the magnetic induction devices employing the techniques of the present invention beneficially have:

- higher coefficient of efficiency (e.g., an increase in the efficiency of the power transformer of up to 99.2%);
- smaller weight of magnetic core (e.g., about 30% to 40% less than a conventional three-phase transformer structure);
- smaller quantities of materials per unit of electrical power (e.g., about 30% to 40%); and
- improved maintainability as compared to conventional three-phase triangular transformers.

There is thus provided according to one aspect of the present invention a magnetic core for a three-phase magnetic induction device, the magnetic core comprising three magnetic core frames, each having internal and external faces, wherein at least the internal face of each frame having a stair-stepped configuration extending along sides portions of the frame, the magnetic core frames are arranged in said magnetic core with their internal faces facing each other thereby forming a triangular prism structure, such that stair-stepped side portions of each frame become engaged with stair-stepped side portions of locally adjacent frames thereby forming three magnetic core legs of the magnetic core for mounting coils of said device thereover. For example, the stair-stepped configuration of the internal faces of the frames may be structured to form a frusto-stepped-pyramid structure.

According to some embodiments the stair-stepped configuration has a pitch of about 30° and the frames are oriented with a 60° angle relative to one another.

The magnetic core frames may comprise a plurality of multilayered loops, each made from wound magnetic material ribbon (e.g., made from an amorphous metal, silicon steel, nanocrystalline alloy, or any other suitable material) and being associated with a specific step of the stair-stepped configuration. For example, in some embodiments each one of the multilayered loops is made from a magnetic material ribbon having a predefined ribbon width, at least some of the multilayered loops are made from ribbons having different ribbon widths, and wherein the ribbons are successively wound one over the other with respect to their ribbon widths to thereby form the stair-stepped configuration. Optionally, at least some of the ribbons are wound one over the other in a descending order of their widths. In this way the magnetic core legs may be constructed having a polygonal cross section shape.

In some embodiments at least some of the ribbons are wound one over the other in an ascending order of their widths. Accordingly, the frames may be fabricated to obtain a circular cross-section perimeter of the core legs (i.e., obtained by engaging the stair-stepped side portions of locally adjacent frames) by winding some inner multilayered loops one over the other in an ascending order of their ribbon widths, and winding some outer multilayered loops thereover, and one over the other, in descending order of their widths.

In some possible embodiments the multilayered loops are wound from magnetic material ribbons having same ribbon width to provide each one of the loops with a predefined loop width and predefined central opening, where at least some of the loops have different loop widths and each frame is constructed by coaxially stacking said loops one on top of the other to thereby form a desired stair-stepped configuration. For example, the stair-stepped configuration may be obtained by coaxially stacking at least some of the multilayered loops one on top of the other in a descending order of their widths.

In some possible embodiments, the geometrical dimensions of the central loop openings of at least some of the loops are different. Thus, a circular cross-sectional perimeter of the core legs may be obtained (i.e., after engaging the stair-stepped side portions of locally adjacent frames) by coaxially stacking at least some of the multilayered loops one on top of the other in an ascending order of their widths with respect to the geometrical dimension of their central openings, and coaxially stacking at least some other of the multilayered loops, on top of the stacked loops, and one on top of the other in a descending order of their widths with respect to the geometrical dimension of their central openings.

In another aspect there is provided a three-phase magnetic induction device comprising a magnetic core comprising three magnetic core frames, each one of the frames having internal and external faces, wherein at least the internal faces being shaped to form a stair-stepped configuration extending along side portions of the frame, the magnetic core frames being arranged in said magnetic core with their internal faces facing each other thereby forming a triangular prism structure, such that stair-stepped side portions of each frame become engaged with stair-stepped side portions of locally adjacent frames thereby forming three core legs. The device further comprises three coil blocks, each one of said coil blocks mounted over one of the core legs.

At least one of the magnetic core frames of the device may comprise a plurality of multilayered loops made from wound magnetic material ribbon (e.g., made from an amorphous metal, silicon steel, or any other suitable material), each one of the loops may be constructed from a magnetic material ribbon having a predefined ribbon width. Accordingly, the stair-stepped configuration may be obtained by successively winding the magnetic material ribbon of the multilayered loops one over the other with respect to their ribbon widths, or by coaxially stacking multilayered loops one on top of the other with respect to their loop widths. In this way the frames may be designed to provide a desired cross section shape of the core legs. For example, in some embodiment the frames may be designed to obtain core legs having a polygonal cross-section shape, or in some other possible embodiments having a circular cross-section perimeter (i.e., circular border/outer boundary of the core leg).

In some applications there is provided a three-phase magnetic induction device comprising a magnetic core comprising three magnetic core frames, each having internal and external faces and a plurality of multilayered loops made from wound amorphous metal ribbon, the loops being successively wound one over the other with respect to their ribbon widths or coaxially stacked one on top of the other with respect to their loop widths, to thereby form a stair-stepped configuration extending along side portions of the frame, the magnetic core frames are arranged in said magnetic core with their internal faces facing each other thereby forming a triangular prism structure, such that stair-stepped side portions of each frame become engaged with stair-stepped side portions of locally adjacent frames thereby forming three core legs. The device further comprises three coil blocks, each one of said coil blocks being mounted over one of the core legs.

According to yet another aspect, there is provided a method of constructing a magnetic core for a three-phase magnetic induction device, the method comprising preparing three magnetic core frames comprising a plurality of multilayered loops, the frames having the desired stair-stepped configuration extending along the side portions of the frames, each one of the loops being wound from a magnetic material ribbon having a predefined ribbon width, and constructing the magnetic core by placing the frames to form a triangular prism structure by engaging the stair-stepped side portions of locally adjacent frames. In this way, the engaged stair-stepped side portions of locally adjacent frames form three magnetic core legs configured to be tightly surrounded by coils of said three-phase magnetic induction device. One or more (or all) of the frames may be prepared by successively winding a plurality of magnetic material ribbons one over the other with respect to ribbon widths of said ribbons. Alternatively the frames may be prepared by separately winding a plurality of multilayered loops from magnetic material ribbons, at least some of the loops having different loop widths, and coaxially stacking the multilayered loops one on top of the other with respect to their loop widths. These frame preparation techniques may be used separately, or in combination (e.g., by stacking some of the separately wound loops on top of the multilayered loops whose ribbons are wound one over the other), to obtain the desired stair-stepped configuration extending along the side portions of the frames.

According to some possible embodiments preparing of the frames comprises an annealing step. The method may further comprise impregnating the frames in a binding material. The constructing of the magnetic core may also comprise applying one or more layers of electrically insulating material between the engaged stair-stepped regions of the locally adjacent frames.

In still yet another aspect there is provided a method of preparing a three-phase magnetic induction device, the method comprising preparing three magnetic core frames comprising a plurality of multilayered loops, each one of said loops being wound from a magnetic material ribbon having a predefined ribbon width, where the loops are arranged in the frames to obtain a stair-stepped configuration extending along side portions of the frames, transversally cutting each one of the frames into upper and bottom parts, arranging the bottom parts of the frames to form a triangular prism structure and engaging the stair-stepped side portions of locally adjacent bottom parts of the frames to obtain three bottom leg portions of the core, placing a coil over each one of the bottom leg portions, and attaching the upper portions of the frames over their respective bottom portions.

The preparing of the frames may comprise successively winding magnetic material ribbons one over the other with respect to widths of the ribbons to form the plurality of multilayered loops. Alternatively, the preparing may comprise separately winding a plurality of multilayered loops from magnetic material ribbons, at least some of the loops having different loop widths, and coaxially stacking the multilayered loops one on top of the other with respect to their loop widths. Optionally, these frame construction techniques may be combined e.g., by stacking some of the separately wound loops on top of the multilayered loops whose ribbons are wound one over the other.

BRIEF DESCRIPTION OF THE DRAWINGS

In order to understand the invention and to see how it may be carried out in practice, embodiments will now be described, by way of non-limiting example only, with reference to the accompanying drawings, in which like reference numerals are used to indicate corresponding parts, and in which:

FIGS. 1A and 1B schematically illustrate a three-phase magnetic induction device according to some embodiments, wherein FIG. 1A shows a perspective view and FIG. 1B shows a top view of the device;

FIGS. 2A to 2C schematically illustrate a three-phase transformer according to some embodiments, wherein FIG. 2A shows a side view of the transformer and a longitudinal section view of its core leg, FIG. 2B shows a top view of the transformer and a cross-sectional view of its core leg, and FIG. 2C shows a sectional view of the transformer taken along lines A-A shown in FIG. 2A, showing a cross-section of the device;

FIGS. 3A to 3C schematically illustrate a multilayered rectangular frame having a stair-stepped configuration, wherein FIG. 3A is a front view of the frame, FIG. 3B is a side view of the frame, and FIG. 3C shows a sectional view of the frame taken along the lines B-B shown in FIG. 3A;

FIG. 4A shows a side view, and a longitudinal section view of a core leg, of the device, FIG. 4B shows a cross-sectional view of the device taken along lines A-A shown in the FIG. 4A, FIG. 4C shows a perspective cross-sectional view of a magnetic core frame of the device, FIG. 4D shows a front view of the frame, and FIG. 4E shows a side view of the frame and upper and bottom sectional cuts thereof;

FIG. 5A shows a cross-sectional view of the magnetic induction device, FIG. 5B shows a front view of a magnetic core frame usable in the device, and FIG. 5C shows a top view of the magnetic core frame and sectional view of its leg portion;

FIG. 7A shows a perspective view of one rectangular multilayered loop made from a wound ribbon that is usable in the construction of the magnetic core frame, FIGS. 7B and 7C exemplify cutting of a magnetic core frame at upper and central locations, respectively, and FIG. 7D shows a perspective view of the bottom part of the magnetic core frame shown in FIG. 7C after cutting.

It is noted that the embodiments exemplified in the figures are not intended to be in scale and are in diagram form to facilitate ease of understanding and description.

DETAILED DESCRIPTION OF EMBODIMENTS

The present application is generally directed to magnetic core circuits for three-phase magnetic induction devices, such as, but not limited to, three-phase chokes and three-phase transformers. Three-phase magnetic core circuits of the present invention are constructed from three magnetic core frames having a stair-stepped configuration formed on at least one face of the frames and extending along their side portions. The magnetic core circuit is constructed by placing the frames locally adjacent one next to the other to form a triangular (triangular prism) structure, where stair-stepped side portions of each frame uniformly engage stair-stepped side portions of adjacently situated frames. The uniformly engaged side portions of the frames form magnetic core legs on which coil blocks of the magnetic induction device are to be placed.

As will be understood from the following disclosure, such a magnetic core design improves distribution of the magnetic flux in the core circuit and reduces electromagnetic losses that typically occur in the core. In addition, such a configuration of the magnetic core requires reduced amounts of core material to fabricate, provides lighter transformer magnetic cores, and improves the efficiency of the magnetic induction device.

Figure 1A:
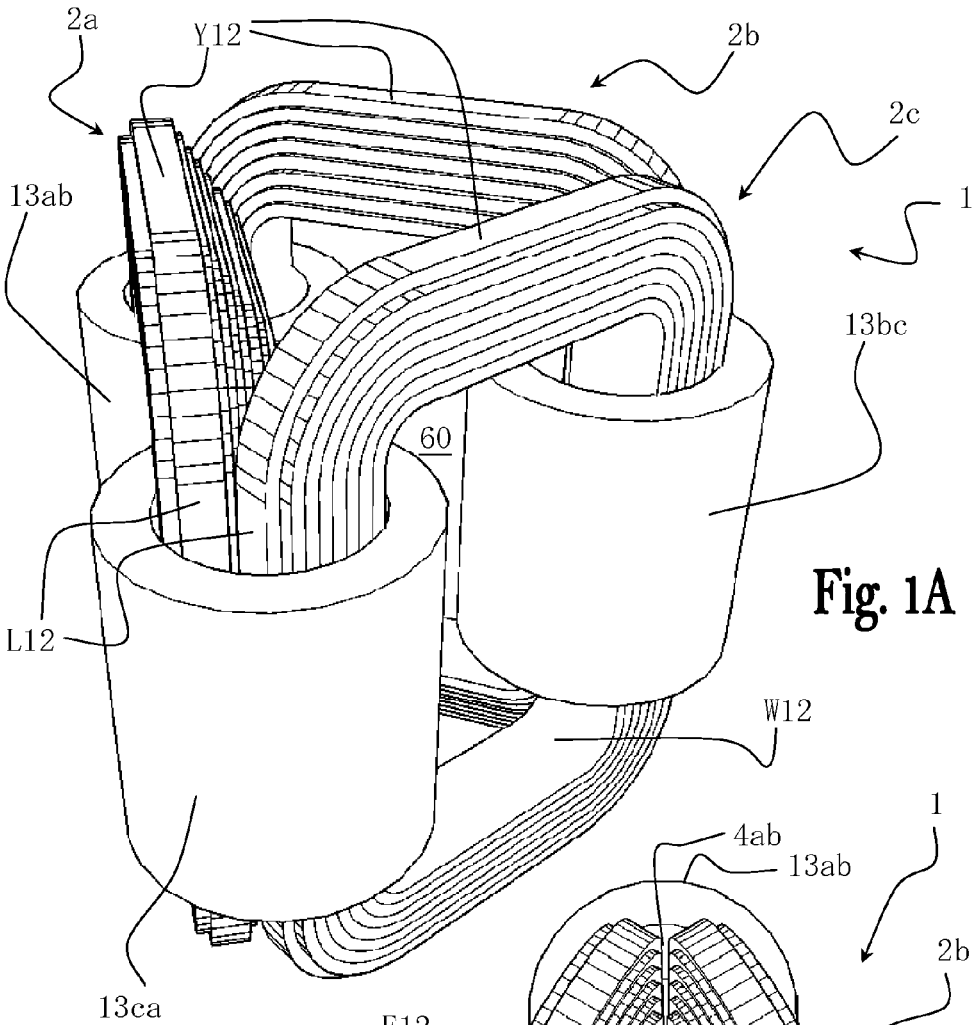
Figure 1B:
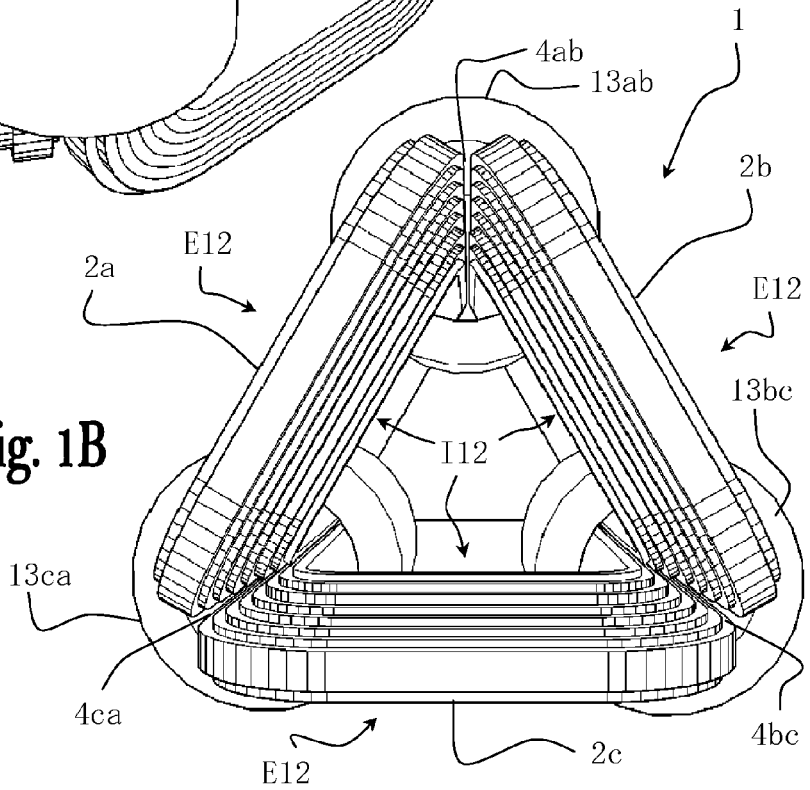

FIGS. 1A and 1B show a three-phase magnetic induction device 60 according to some possible embodiments. In this example the magnetic core circuit 1 of the device 60 is constructed from three generally rectangular multilayered magnetic core frames 2*a*, 2*b* and 2*c* (collectively referred to herein as frames 2), where inner faces I12 of the frames 2 are configured to form a stair-stepped configuration extending along the sides of the frames. As best seen in FIG. 1B, stair-stepped side portions of locally adjacent frames 2 are uniformly engaged to form core legs 4*ab*, 4*bc* and 4*ca* (collectively referred to herein as core legs 4), of the magnetic core 1, over which coil blocks 13*ab*, 13*bc* and 13*ca* (collectively referred to herein as coil blocks 13) are respectively placed.

In general, each one of the magnetic core frames 2 comprises two lateral leg portions L12 (shown in FIG. 2A), defined by the sides of the frame, two yoke portions Y12 defined by the top and bottom portions of the frame, and a rectangular central window W12 enclosed by the leg and yoke portions. The frame and its central window W12 may have round corners. Each one of the frames 2 includes an external face E12 and an internal face I12, where at least the internal face of the frames 2 includes the stair-stepped configuration.

For example, the magnetic core circuit 1 may be constructed by arranging the magnetic core frames 2 such that their yoke portions forms an equilateral triangular structure. In this configuration a triangular prism (pentahedron) structure may be obtained by situating the magnetic core frames 2 at an angle of 60° one relative to the other, thereby assembling the core legs 4 by engaging (mating) stair-stepped leg portions of adjacently located magnetic core frames. This triangular structure of the magnetic core 1 typically comprises upper and bottom triangular yoke structures, where the corners of the triangular yoke structures are connected by the core legs 4. Accordingly, each leg of the triangular magnetic core is constructed from two engaged stair-stepped leg portions L12 of adjacently located magnetic core frames 2.

As exemplified in FIGS. 1A and 1B, the geometrical dimensions of the leg portions L12 are configured to provide a cross-sectional shape of the magnetic core legs 4, suitable for placing the coil blocks 13. In addition, the dimensions of the central windows W12 provided in the frames 2 should be so configured to enable it to accommodate the coil blocks mounted on the core legs 4 between which the window W12 is enclosed.

Figure 2A:
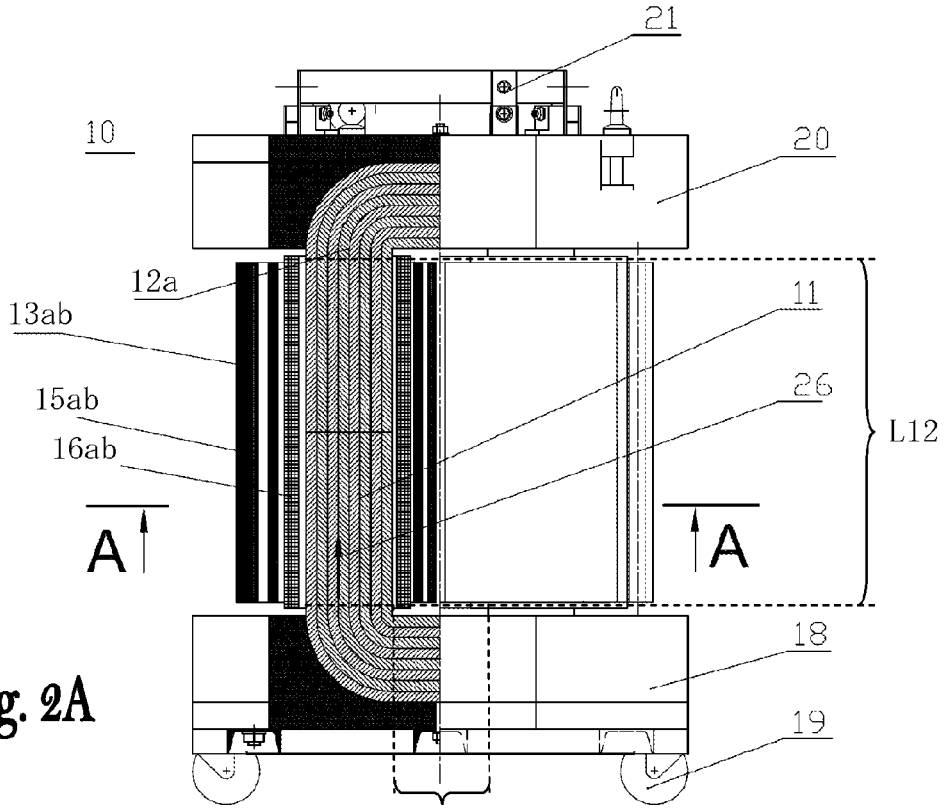
Figure 2B:
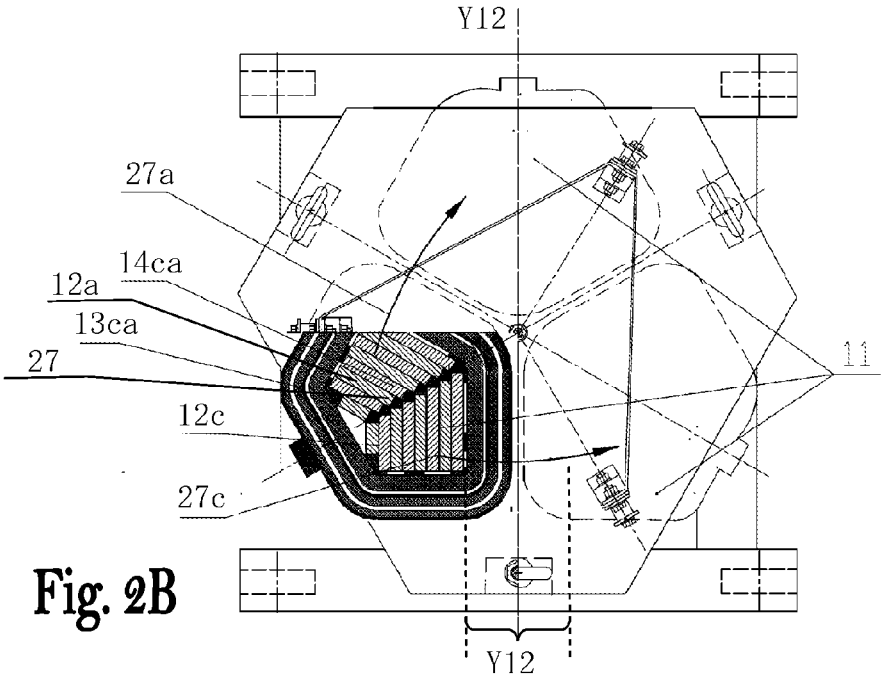
Figure 2C:
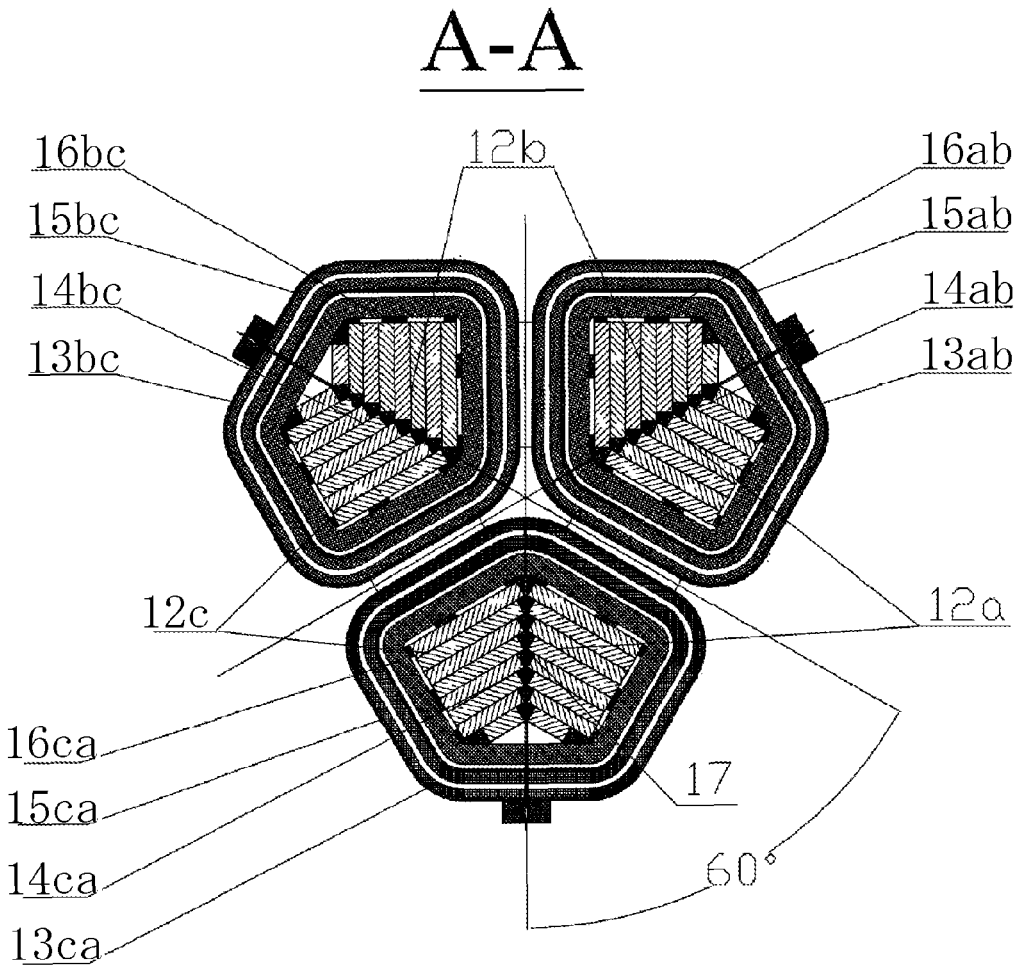

FIGS. 2A to 2C schematically illustrate a three-phase transformer 10 according to some possible embodiments. The magnetic core circuit 11 of the transformer 10 is comprised of three multilayered rectangular magnetic core frames 12*a*, 12*b* and 12*c* (collectively referred to herein as core frames 12). As exemplified above, the magnetic core frames 12 are arranged such that each frame is situated at an angle of 60° one relative to the other, and the stair-stepped regions of the leg portions L12 of neighboring core frames 12 are engaged to form magnetic core legs 14*ab*, 14*bc* and 14*ca* (collectively referred to herein as core legs 14), over which coil blocks 13 are mounted.

FIG. 2C shows a cross-sectional view of the magnetic core circuit 11 and of the coil blocks 13 placed over its core legs 14. As seen, three coil blocks 13*ab*, 13*bc* and 13*ca*, are mounted over corresponding magnetic core legs 14*ab*, 14*bc*, 14*ca*, each coil block being associated with an electrical phase of the three-phase transformer 10. For example, coil block 13*ab* associated with the first phase of the transformer is placed over magnetic core leg 14*ab* formed by mated leg portions of magnetic core frames 12*a* and 12*b*, coil block 13*bc* associated with the second phase of the transformer is placed over magnetic core leg 14*bc* formed by mated leg portions of magnetic core frames 12*b* and 12*c*, and coil block 13*ca* associated with the third phase of the transformer is placed over magnetic core leg 14*ca* formed by mated leg portions of magnetic core frames 12*c* and 12*a*.

As shown in FIGS. 2A to 2C, each coil block 13*ab*, 13*bc* and 13*ca*, includes a respective primary coil winding 15*ab*, 15*bc* and 15*ca* (collectively referred to herein as primary coil windings 15), and a respective secondary coil winding 16*ab*, 16*bc* and 16*ca* (collectively referred to herein as secondary coil windings 16). In some embodiments the secondary coil windings 16 are coaxially enclosed by the primary coil windings 15.

In some embodiments the engaged leg portions L12 of adjacently situated magnetic core frames 12*a*, 12*b*, and 12*c*, are electrically insulated from each other by one or more layers of electrically insulating material 17 (e.g., glass fiber or plastic) disposed therebetween over the stair-stepped regions of the leg portions L12. Accordingly, each electric phase of the three-phase transformer 10 is formed by a respective magnetic core leg 14*ab*, 14*bc* or 14*ca* having a corresponding coil block 13*ab*, 13*bc* and 13*ca*, placed over it.

Referring back to FIG. 2A, the three-phase transformer 10 may comprise a base 18 on which the three-phase transformer 10 is mounted. The base 18 may include wheels 19 for moving the transformer 10 from one location to another. The transformer 10 may further include a top clamping plate 20 made from an electrically insulating material (e.g., Pregnit GGBE, Catalog KREMPLER) and in which leading-out wires 21 of the secondary winding (16) may be provided.

In operation an electrical current passes through the primary windings 15 of the coils 13 and a responsive magnetic flux is generated, which propagates along the corresponding magnetic core legs 14. The magnetic flux propagating in each of the legs 14 is divided into the respective yoke portions Y12 connected to the engaged leg portions of the respective frames 12. For example, in FIGS. 2B and 4B, the magnetic flux 27 evolving in the magnetic core leg 14*ca* is divided into two even magnetic fluxes, 27*c* and 27*a*, passing through the yoke portions Y12 of magnetic core frames 12*c* and 12*a* respectively. In a similar manner, the magnetic fluxes evolving in the magnetic core legs 14*ab* and 14*bc* are evenly divided for passage through the respective yoke portions Y12 of respective core frames (12*a*, 12*b*) and (12*b*, 12*c*).

With reference to FIGS. 3A to 3C, in some embodiments the magnetic core frames 12 are constructed from a plurality of generally rectangular multilayered loops, where each one of the loops is made from wound magnetic material ribbon. In this example, the ribbons of the multilayered loops are wound one over the other to form a stair-stepped configuration on at least the internal faces I12 of the frames 12. In this way the stair-stepped design is formed on both the legs and yoke portions of the frames, and a frusto-stepped-pyramid configuration is formed on the internal faces I12 of the frames 12. For instance, the multilayered loops may be fabricated from magnetic material ribbons having different ribbon widths by successively winding the ribbons one over the other, in a descending order of their widths, to thereby form the stair-stepped configuration of the frames. Accordingly, the number of turns in each loop defines the thickness of the loop/step, which is preferably equal in all of the loops/steps.

The multilayered loops are generally rectangular loops and they are typically wound one over the other such that a rectangular central window W12 is obtained in the frames 12. Accordingly, the successive winding of loops one over the other forms a frusto-stepped-pyramid structure (e.g., with a 30° angle between the base and each side of the pyramid) on at least one face of the frames, and the central window W12 thereby provided is adapted to accommodate the coils 13 placed over the legs 14 located at the sides of the central window W12.

In this example the stair-stepped face I12 of the frames 12 comprises eight steps, indicated in FIGS. 3A-C by reference numerals $r_1$ to $r_8$, wherein the innermost wound ribbon step $r_1$ is of the greatest width, and the outermost wound ribbon step $r_8$ is of the smallest width. The thickness 33 (T) of each step/loop $r_i$ (where i is a positive integer e.g., $1 \le i \le 8$) is determined by the number of turns of magnetic ribbon material in the step/loop, which may be identical in all of the loops to provide the same thickness to all of the steps/loops e.g., about 20 mm.

More particularly, the width $w_{i+1}$ of each subsequent step $r_{i+1}$ is discretely decreased to thereby form the desired stair-stepped configuration. For example, in some embodiments the ribbon width $w_{i+1}$ of each successive step $r_{i+1}$ (where the first step $r_1$ is the innermost step) of the stair-stepped configuration is decreased by an amount of T·tg(30°), where T is the thickness 33 of the steps $r_1$ to $r_8$. Accordingly, the thickness of each successive step $r_{i+1}$ in this 30° pitch stair-stepped configuration may be computed as follows:

$$w_{i+1}=w_i-T\cdot tg30°=w_i-0.577\cdot T \quad (1)$$

Accordingly, if the thickness of each step $r_i$ is 20 mm, then the thickness $w_{i+1}$ of each successive step $r_{i+1}$ in this 30° stair-stepped configuration is $w_{i+1}=w_i-11.54$ mm. In the embodiment exemplified in FIGS. 3A-C the outermost step $w_8$ (i.e., the step having the smallest width) does not comply with equation (1), and its width is actually further reduced (i.e., $w_8<w_7-T\cdot tg30°$) in order to obtain smaller external side surface of the magnetic core legs 14.

Using such stair-stepped configuration of the external face I12 of the frames 12 results in a right trapezoidal cross-sectional shape of the leg (L12) and yoke (Y12) portions having an acute angle of 60°. Accordingly, when assembling the frames 12 to construct the magnetic core 11, the cross-sectional shape of the magnetic core legs 14 obtained by engaging each pair of leg portions of adjacently situated frames 12 consists of two reflection symmetric polygons (e.g., rectangular trapezoid having an acute angle of 60°), thus resulting in a pentagon cross-sectional shape of the magnetic core legs 14.

With reference to FIG. 3C, in some exemplary embodiments, the winding process of the magnetic core frames 12 is initiated by winding of the innermost multilayered step $r_1$ using soft ferromagnetic ribbon having a predetermined length and the greatest width 23 ($w_1$). The winding of the step r1 proceeds until a required thickness 33 (T) is obtained e.g., about 20 mm Thereafter, the next multilayered loop $r_2$ is wound thereover using another soft ferromagnetic ribbon having a predetermined length and a width that is smaller than the width of the ribbon used for the first loop, $w_2<w_1$, for forming the next multilayered step $r_2$, which is wound until the desired step thickness 33 (T) is obtained. This process similarly proceeds for multilayered loops/steps $r_3$ to $r_8$. The last layer of the wound ribbon may be secured to the adjacent layer, for example, by welding.

The amount of layers used for forming a single step $r_i$ of the stair-stepped design of the magnetic core, and the geometric dimensions of the layers in each such step, depend on the working power that the three-phase transformer 10 is designed for.

After winding the core frames 12, the multilayered frames 12 may go through an annealing process whose parameters (e.g., temperature and time duration) are determined based on the type of alloy from which the wound ribbon of the frames 12 is made from. The core frames 12 may be annealed with the mandrel still inserted therein. The annealing may be performed with or without the application of an external magnetic field to the core frames 12. In some embodiments the annealed core frames are impregnated with an organic binding material (e.g., an epoxy resin) in a vacuum chamber, or in an ultrasonic bath. After the impregnation, the core frames 12 are placed in a temperature-controlled environment. Next, the mandrel is removed from the core frames 12.

With reference to FIG. 2C, in some embodiments the engaged leg portions L12 of locally adjacent magnetic core frames are separated one from the other by one or more electrically insulating layers 17. With this stair-stepped configuration the coil blocks 13 placed over the magnetic core legs 14 of the core 11 may assume pentagon shapes in order to tightly fit over the pentagon cross-sectional shape of the magnetic core legs 14. For example, the coil blocks 13 may be prepared using any suitable wire turning technique e.g., using a wood mandrel.

Figure 4A:
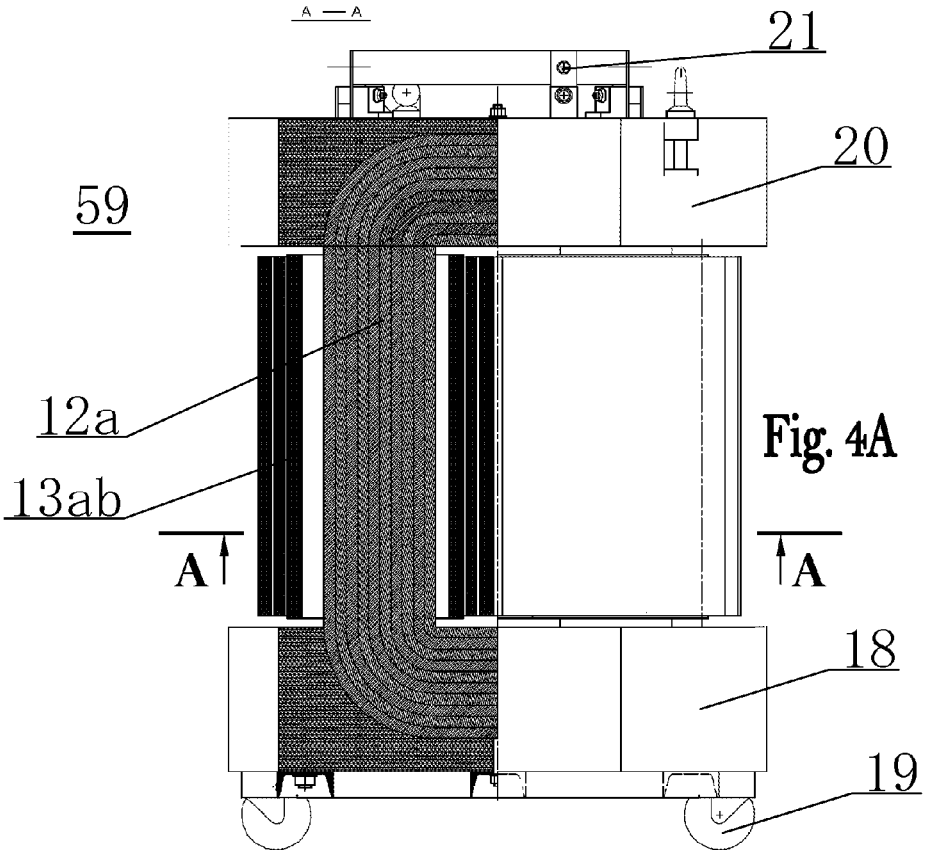
FIGS. 4A to 4E schematically illustrate a three-phase magnetic induction device according to some embodiments wherein the frames of the magnetic core are configured to provide core legs having a circular cross-sectional perimeter, where
Figure 4B:
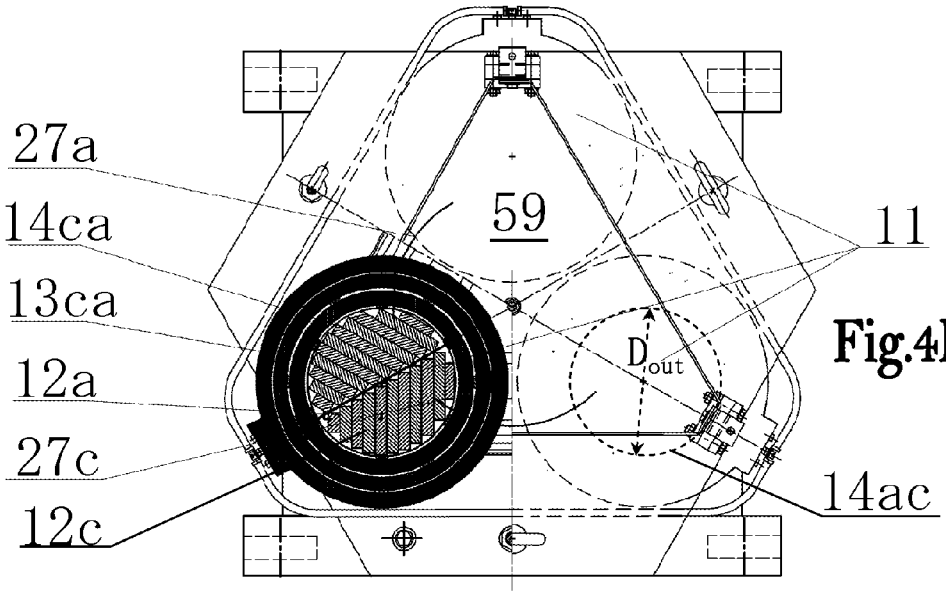
Figure 4C:
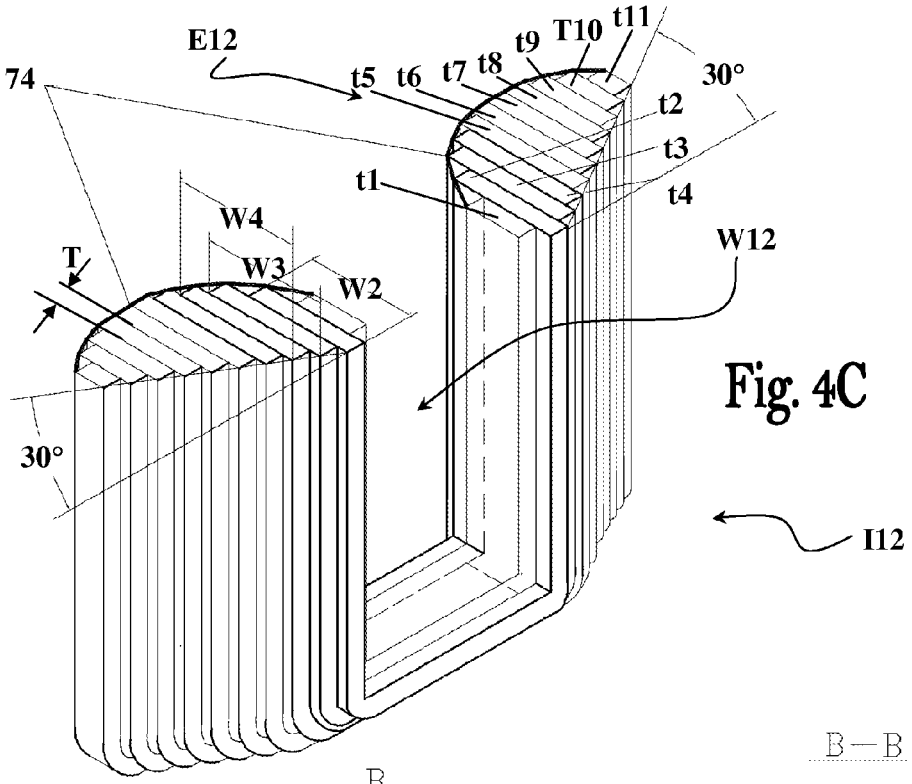
Figure 4D:
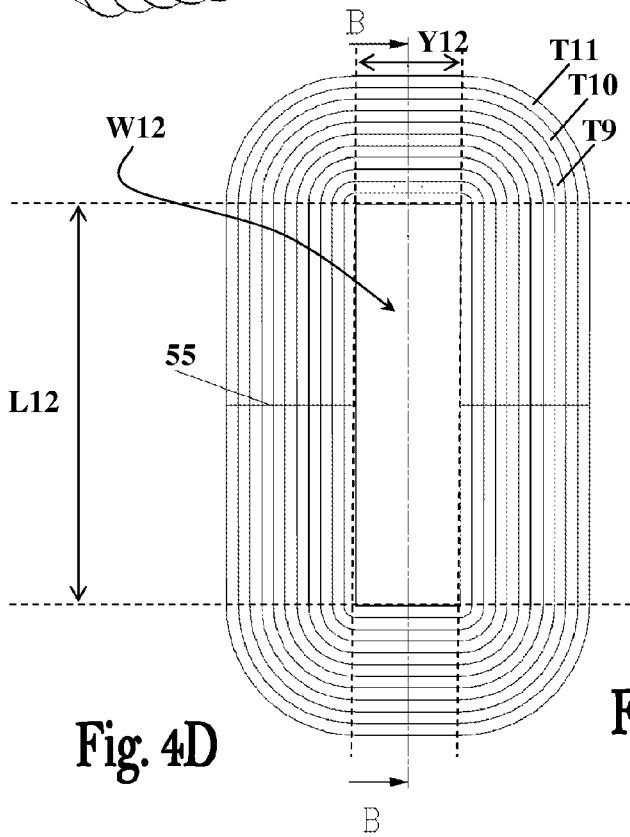
Figure 4E:
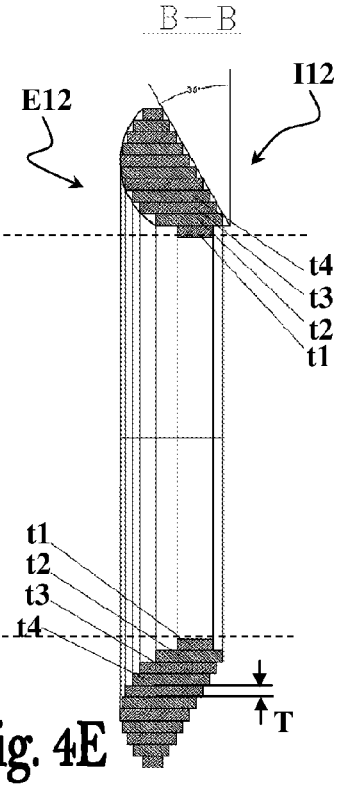

FIGS. 4A to 4E exemplify a three-phase transformer 59, according to some possible embodiments, in which the magnetic core legs 14 have a circular cross-sectional perimeter shape. In this example the magnetic core frames 12 of the magnetic core 11 are constructed from multilayered loops, each constructed from a wound magnetic material ribbon, configured to provide a stair-stepped configuration of the internal faces I12 of the frames, and a curved cross-sectional shape of the external faces E12 of the frames. More particularly, in this example the internal face I12 of each frame 12 is configured in a shape of a frusto-stepped-pyramid (e.g., having a 30° angle between the base and faces) having a central window W12, and the external sides of the leg portions L12 of the frames 12 are configured to define a curved cross-sectional shape, such that the engaged leg portions of adjacently situated leg portions L12 of neighboring frames 12 form a circular cross-sectional perimeter shape of the magnetic core legs 12. As best seen in FIG. 4B, with this configuration the magnetic core leg of each electric phase of the device 59 provides maximal occupation of the space enclosed by the coils 13 (e.g., having a circular inner diameter) placed over the core legs 14 with the magnetic core material of the frames 12. In this case the thickness T of each step/loop $t_i$ should be minimal, where the thickness T may be determined based on specific properties of the power of the transformer e.g., transformer power.

For example, in order to obtain such circular cross-sectional shape of the core legs 14, in some embodiments at least some the inner loops (e.g., t1 to t5) of the frames 12 are wound one over the other in an ascending order of their thicknesses, and at least some the outer loops (e.g., t6 to t11) of the frames 12 are wound one over the other in a descending order of their thicknesses.

In some embodiments the magnetic core frames are fabricated from several rectangular multilayered loops of wound magnetic material ribbon, each one of the loops being fabricated from ribbons having identical widths and having a different central opening, and different number of turns. In this configuration the width of the ribbons defines the thicknesses (T) of the multilayered loops, such that using magnetic material ribbons having identical width yields multilayered loops having identical thicknesses, and whose widths are defined by the number of turns in each loop, as demonstrated in FIG. 7C. With this technique magnetic core frames may be constructed by coaxially stacking (superposing together) a plurality of the rectangular multilayered loops one on top of the other with respect to their widths, to form magnetic core frames having a desired cross-sectional shape.

It is known that properties of the magnetic core of the magnetic induction device determine various properties of the device, such as the size and shape of the induction coils. For example, in three-phase transformers, the transformer's design, the size and shape of the transformer coils, and the overall size of the transformer, are determined based on the geometrical and structural properties of the transformer's core.

Accordingly, various properties of the magnetic induction devices of the present application may be advantageously determined based on the diameter $D_{out}$ of the magnetic core legs (4 in FIGS. 1A-1B and 14 in FIGS. 2B-2C and 4B) and the stair-stepped configuration of the leg portions of the frames constructing them. As exemplified hereinabove with reference to FIGS. 4A-4E, stair-stepped configuration of the frames may be adjusted to obtain magnetic core legs having a circular cross-sectional perimeter shape.

In some possible embodiments the diameter $D_{out}$ (shown in FIG. 4B) of the circle which circumscribes magnetic core legs of the device is determined as follows:

$$D_{out} = \sqrt{\frac{4 \cdot K_1}{\pi} \cdot \left( S_{core} + 0.2 \frac{b_1 \cdot n_1}{\cos 30^\circ} + 0.5 \frac{b_1^2 \cdot n_1}{\cos 30^\circ} \right)} \tag{2}$$

where, $S_{core}$ is the calculated cross-sectional area (in cm) of the magnetic core (obtained by electrical calculation related to the magnetic induction device), for example, for a three-phase transformer, $S_{core}$ may be determined based on the power, efficiency, operating frequency, of the transformer and properties of the core material (e.g., in case amorphous metal ribbon is used to construct the frames, the induction of material, the electrical losses in the amorphous ribbon, etc.), $b_1$ is the thickness T (in cm, 33 in FIG. 3C) of the multilayered loops $r_i$, $n_1$ is the number of loops ($r_1$, $r_2$, . . . );

$K_1$ is a coefficient of filling a circle area having a diameter $D_{out}$ by stepped cross-sectional area of the magnetic core. $K_1$ may be determined based on the transformer power. For example, in some of the embodiments exemplified in FIGS. 4A-4E, the filling coefficient $K_1$ is about 1.05 to 1.25 e.g., the filling coefficients $K_1^{(20)}$ for ribbon width of $b_1$=20 mm and $K_1^{(10)}$ for ribbon width of $b_1$=10 mm substantially fulfill a quadratic relationship, as follows—$K_1^{(20)}=(K_1^{(10)})^2$.

Equation (2) may be thus used to calculate a cross-sectional diameter $D_{out}$ of the magnetic core legs of the device, and accordingly the geometrical dimensions (e.g., size and shape) of the coil blocks 13 to be mounted on magnetic core legs and the geometrical dimensions of the internal windows W12 of core frames 12 may be determined based on the calculated cross-sectional leg diameter $D_{out}$ of the core.

Figure 5A:
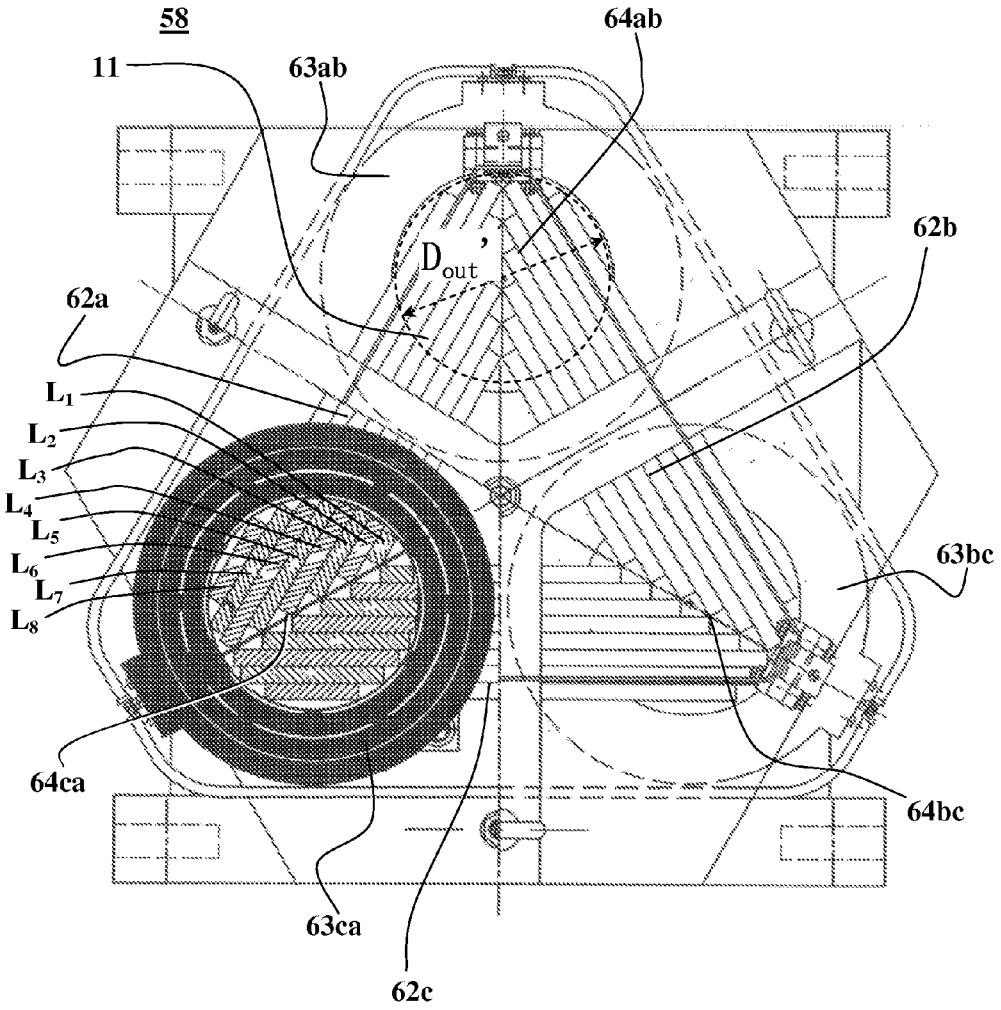
FIGS. 5A to 5C schematically illustrate a magnetic induction device according to some embodiments wherein the magnetic core of the device is constructed from a stack of magnetic core loops, where
Figure 5B:
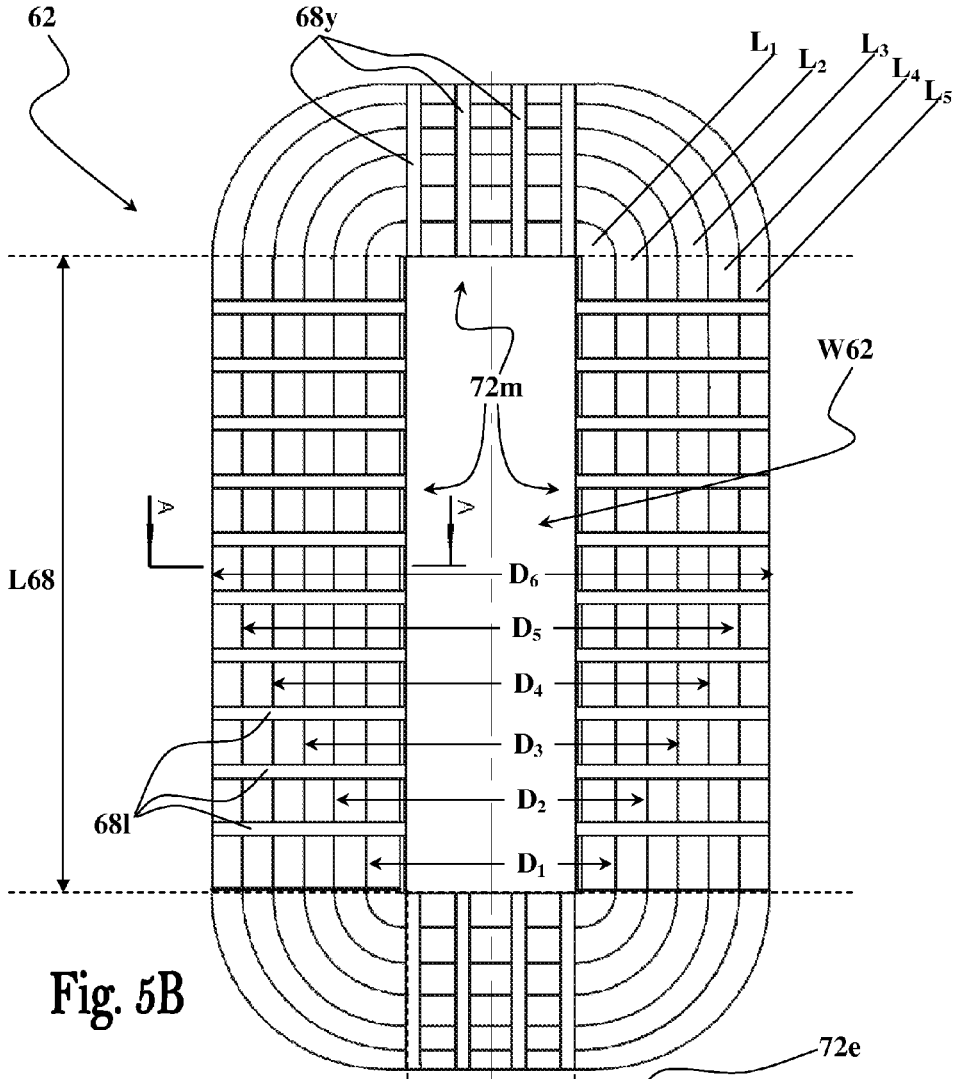
Figure 5C:
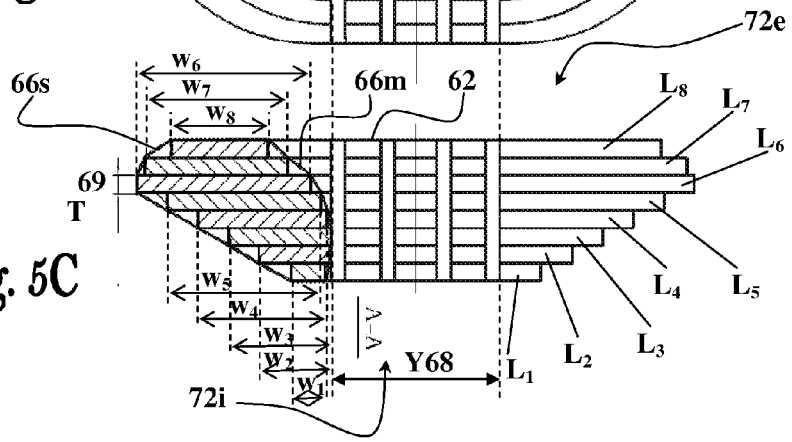

FIGS. 5A to 5C depicts a magnetic induction device 58 according to some possible embodiments in which the magnetic core frames 62*a*, 62*b* and 62*c* (collectively referred to herein as frames 62) are constructed by coaxially stacking a plurality of multilayered loops L1, L2, . . . , L8, one on top of the other. In this embodiment the plurality of multilayered ribbon loops $L_i$ (e.g., $1 \le i \le 8$) are stacked one on top of the other to provide a stair-stepped configuration of the inner face 72*i* of the frames 62 and form a central window W62 for accommodating the coil blocks (63). For example, the multilayered loops $L_i$ may be manufactured from ribbons having a fixed width T, which thus defines a fixed thickness for the steps/loops of the stair-stepped configuration. The number of turns in each loop $L_i$ may be different to adjust the width $w_i$ of leg portion of each loop $L_i$ so as to obtain a frusto-stepped-pyramid configuration (e.g., having 30° angle between the base and faces of the pyramid and a central window W62) on the inner side 72*i* of the frames 62. In some embodiments the width $w_i$ of the leg portion of each loop $L_i$ is further adjusted to obtain in each multilayered loop $L_i$ an internal opening (I12 in FIG. 7A) having different geometrical dimensions (e.g., height and/or width) to thereby configure the cross-sectional shape of the external face 72*e* and of the medial sides 72*m* of the frames 62 to assume a circular perimeter shape.

As seen in FIGS. 5A to 5C, each one of the frames 62 is assembled by coaxially stacking a plurality of multilayered loops $L_i$ on top of the other. The magnetic circuit core 11 in this example is assembled by placing three such multi-loop frames 62 at an angle of 60° one relative to the other, and engaging the stair-stepped side regions of leg portions of locally adjacent magnetic core frames 62, one with the other, to thereby obtain an equilateral triangular structure of the yoke Y68 portions. The engaged leg portions L68 of pairs of locally adjacent frames 62 form the magnetic core legs 64*ab*, 64*bc* and 64*ca* (collectively referred to herein as core legs 64), of the magnetic core circuit 11. In this example, the coil blocks 63*ab*, 63*bc* and 63*ca* (collectively referred to herein as coil blocks 63), respectively placed over the core legs 64*ab*, 64*bc* and 64*ca*, are generally circular in shape (i.e., having a circular perimeter) to tightly encircle the magnetic core legs 64. The coil blocks 63 may each comprise primary and secondary windings, where the secondary coil windings are coaxially enclosed by the primary coil windings, as described hereinabove.

In some possible embodiments the widths $D_i$ (e.g., $1 \le i \le 8$) of the multilayered loops and/or the geometrical dimensions of the internal openings I12, of at least some of the loops $L_i$ are different, and the loops are coaxially stacked one on top of the other such that curved cross-sectional shapes are formed at the lateral side regions 66*s* and medial side regions 66*m* of the constructed frames 62. In this way, the widths $D_i$ and the geometrical dimensions of the internal openings I12, of the loops $L_i$ may be so adjusted to obtain a circular cross-sectional perimeter of the core legs 64 obtained by engaging the stair-stepped side regions of the leg portions of the frames 62 to form the triangular prism structure of the core.

For example, in possible embodiments, the core frames 62 are constructed by coaxially stacking, starting from the external loop (e.g., $L_8$, having loop width $D_8$), one or more loops in ascending order of their loop widths (e.g., $DL_8$ to $D_6$), and then coaxially stacking thereon one or more loops in a descending order of their loop widths (e.g., $D_5$ to $D_1$). Support elements 68*y* and 681 (e.g., supporting bands) may be wrapped around regions of the yoke and/or leg portions of the frame 62 to hold and prevent movement of the stacked loops $L_i$, and thereby maintain the stair-stepped configuration of the frame 62. In some possible embodiments the stacked loops $L_i$ of each core frame 62 are further adhered one to the other by hot-melt binding.

In some possible embodiments the diameter $D_{out}'$ (shown in FIG. 5A) of the circle which circumscribes magnetic core legs of the devices is determined as follows:

$$D'_{out} = \sqrt{\frac{4 \cdot K_2}{\pi} \cdot \left(S_{core} + 0.4 \cdot b_2 \cdot n_2 + 2\frac{b_2^2 \cdot n_2}{\cos 30^\circ}\right)} \tag{3}$$

where, $S_{core}$ is the calculated cross-sectional area (in cm) of the magnetic core (obtained by electrical calculation related to the magnetic induction device), for example, for a three-phase transformer, $S_{core}$ may be determined based on the power, efficiency, operating frequency, of the transformer and properties of the core material (e.g., in case amorphous metal ribbon is used to construct the frames, the induction of material, the electrical losses in the amorphous ribbon, etc.), $b_2$ is the width T (in cm, 69 in FIG. 5C) of the wound ribbons, $n_2$ is the number of loops in each frame;

$K_2$ is a coefficient of filling a circle area having a diameter $D_{out}'$ by stepped cross-sectional area of the magnetic core. $K_2$ may be determined based on the transformer power.

For example, in some of the embodiments exemplified in FIGS. 5A-5C, the filling coefficient $K_2$ is about 1.03 to 1.2 e.g., the filling coefficients $K_2^{(20)}$ for ribbon width of $b_2$=20 mm and $K_2^{(10)}$ for ribbon width of $b_2$=10 mm substantially fulfill a quadratic relationship, as follows—$K_2^{(20)}=(K_2^{(10)})^2$.

Equation (3) may be thus used to calculate a cross-sectional diameter $D_{out}'$ of the magnetic core legs of the device, and accordingly the geometrical dimensions (e.g., size and shape) of the coil blocks 13 to be mounted on magnetic core legs, and the geometrical dimensions of the internal windows W62 of core frames 62 may be determined based on the calculated cross-sectional leg diameter $D_{out}'$ of the core.

Figure 6:
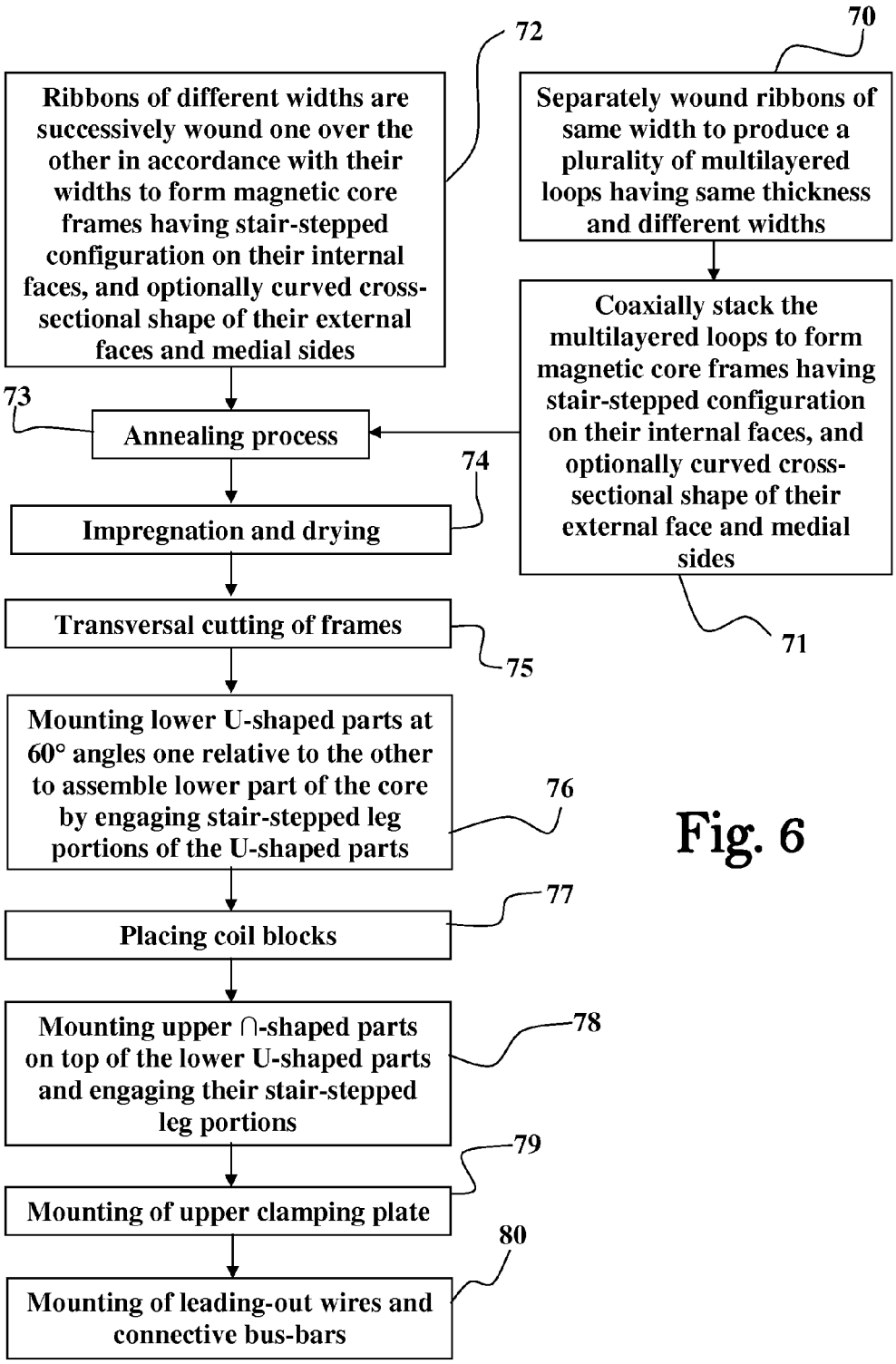
FIG. 6 is a flowchart demonstrating a possible process for fabricating a three-phase magnetic induction device according to some possible embodiments.

FIG. 6 is a flowchart demonstrating possible fabrication techniques of the magnetic induction devices of the present application. One or more of the magnetic core frames may be fabricated from a plurality of magnetic material ribbons having the same width, by preparing a plurality of rectangular multilayered loops ($L_i$), each one of the loops having the same thickness (i.e., equal to the width of the ribbon) and optionally different widths and dimensions of their internal openings (i.e., determined by the number of ribbon turns), and coaxially stacking the multilayered loops one on top of the other to form stair-stepped configuration of the inner face of the frame, and/or curved cross-sectional shape of the external faces and medial sides of the frames, as specified in steps 70-71.

Alternatively, one or more of the magnetic core frames may be fabricated by successively winding a plurality of magnetic material ribbons, at least some of the ribbons having different ribbon widths, where the ribbons are successively wound one over the other with respect to their widths, to thereby obtain a stair-stepped configuration of the inner face of the frames, and optionally curved cross-sectional shape of the external face and medial sides of the frames, as specified in step 72.

The magnetic core frames 12 may be fabricated from amorphous metal ribbons made from an alloy having soft ferromagnetic properties, as may be required for the magnetic core circuit of the device 10. It is known that amorphous ribbons have good ferromagnetic properties and the structure of the magnetic core circuit 11 of device 10 benefits from these properties in practical implementations of the device structure. The core frames 12 may be manufactured using a conventional spooling machine for winding the magnetic material ribbon over a rectangular shaped mandrel whose dimensions correspond to the internal window W12 of core frames 12, and which preferably has rounded corners. For example, the core frames may be fabricated as specified in steps 70-71 using a ribbon having a thickness of 25 microns which is wound to produce multilayered loops having a thickness T of about 20 mm. It is noted that the amorphous ribbons commercially available nowadays are typically obtainable in widths ranging from 20 to 230 mm.

Next, in step 73, the magnetic core frames undergo an annealing process. For example, the wound core frames obtained in steps 70-71, and/or in step 72, may be placed, optionally together with the mandrel over which the magnetic material loops were wound, in a heat-treatment process in a furnace, e.g., at a temperature of 400° C., and then maintained for slow cooling in the furnace.

In step 74 the magnetic core frames are impregnated with cementing varnish (e.g., epoxy), and then dried in the furnace, for example at a temperature of about 130° C. The magnetic core frames are then transversally cut in step 75 for mounting of the lower parts of the cut frames and placement of the coil blocks over their leg portions, as specified in steps 76-77. With reference to FIGS. 7A to 7D, in some embodiments the wound magnetic core frames 12 are cut along a transversal axis, 61 or 62, into upper ∩12 and lower U12 parts. As exemplified in FIG. 7C, in possible embodiments the magnetic core frames are cut more or less along their axes of symmetry 62 into symmetric ∩-shaped (∩12) and U-shaped (U12) parts. In other possible embodiments, as demonstrated in FIG. 7B, the frames may be transversally cut above the center of the frames to obtain asymmetric ∩-shaped (∩12) and U-shaped (U12) parts.

Figure 7A:
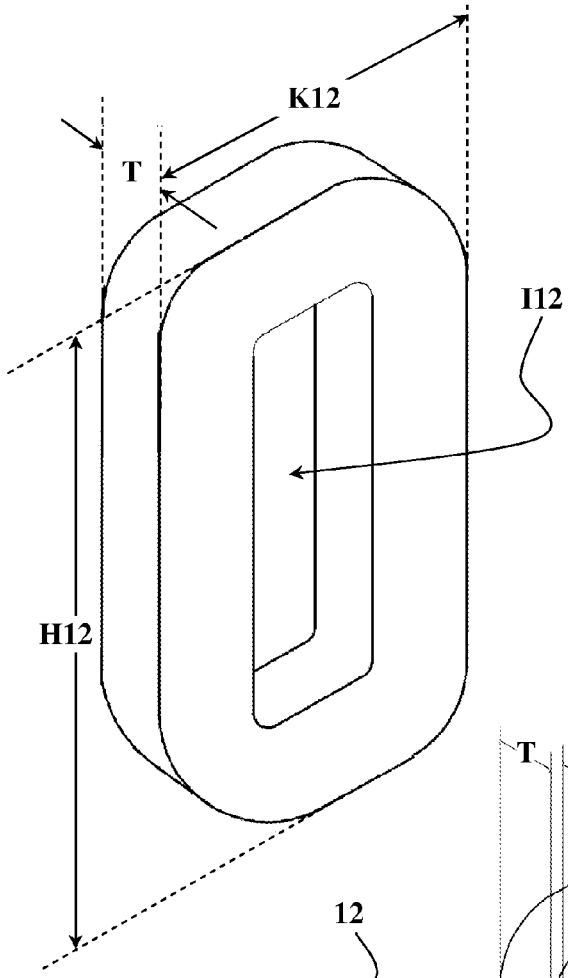
FIGS. 7A to 7D schematically illustrate a core frame structure according to some possible embodiments, where
Figure 7B:
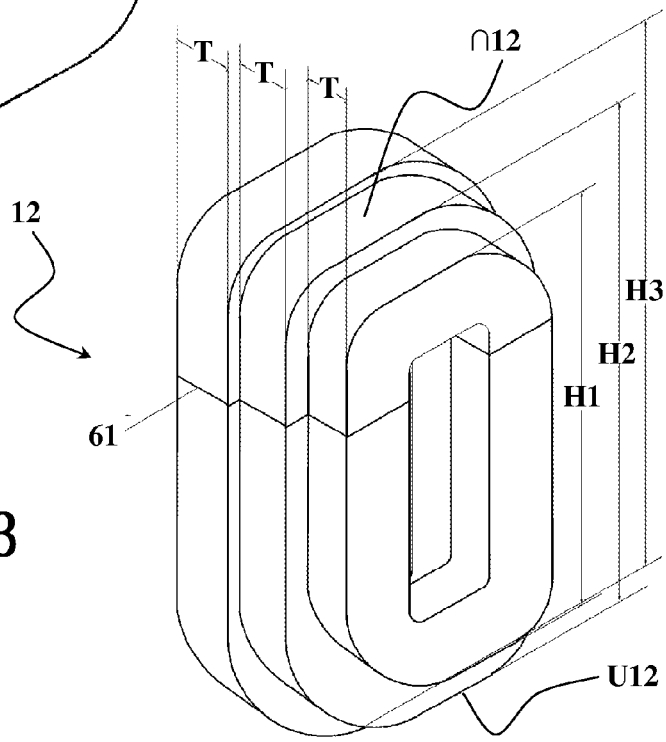
Figure 7C:
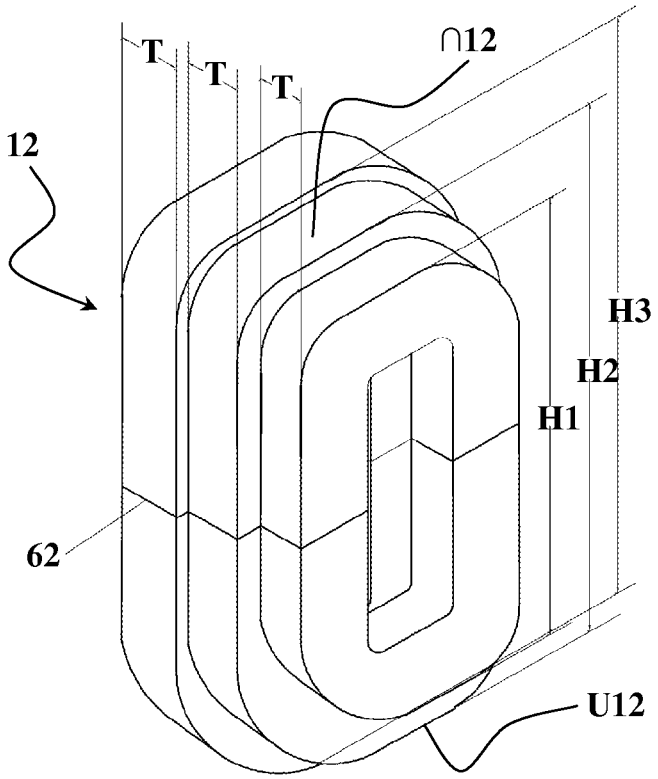
Figure 7D:
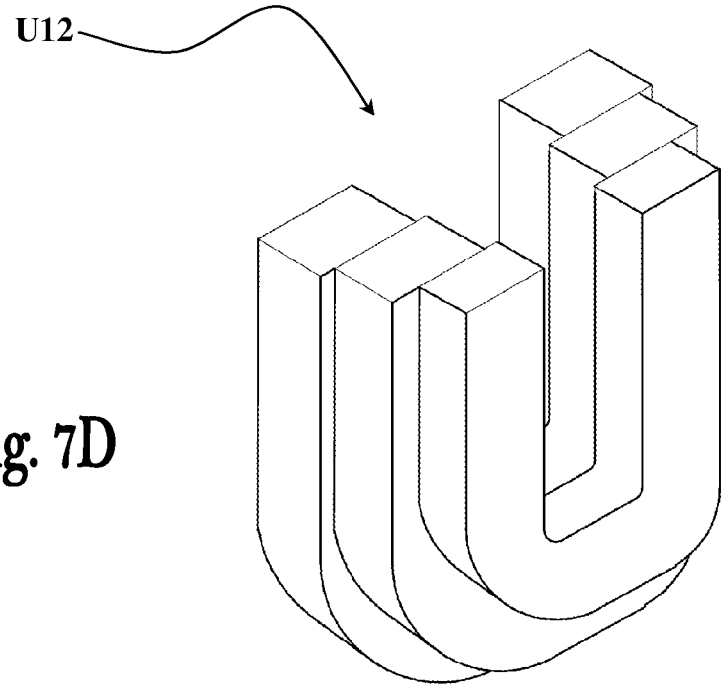

In this example, the height H12 of the first loop shown in FIG. 7A, may be about 1120 mm, and the width of the yokes K12 may be about 636 mm.

In step 76 the three U-shaped lower cuts U12 (shown in FIG. 7D for example) of frames 12*a*, 12*b* and 12*c*, are secured to the base 18 of the device. The base 18 may comprise corresponding grooves configured to receive the yoke portions of the lower cuts U12 at an angle of 60° one relative to the other, for mounting them on the base 18. As described hereinabove, stair-stepped regions on the leg portions of the lower cuts U12 are engaged with stair-stepped regions of leg portions of locally adjacent lower cuts U12, thereby forming the lower parts of magnetic core legs (14) of the core 11. Then, in step 77, the coil blocks (13) of each phase e.g., composed of primary windings (15) and secondary windings (16), are mounted on the corresponding lower parts U12 of the magnetic core legs (14).

Thereafter, in step 78, the three corresponding ∩-shaped upper cuts ∩12 of the magnetic core frames (12) are mounted vertically on top of the respective lower cuts U12, to thereby restore the rectangular structures of the magnetic core frames (12). Next, in step 79, the upper clamping plate 20 is mounted on top of the restored frames (12)(the upper and lower cuts may be attached to each other by means of plates 18 and 20 and fixing bolts, as shown in FIG. 2A at 20.), and finally, in step 80, the leading-out wires and connective bus-bars are mounted.

In some embodiments four draw studs are used for securing the device parts together. For example, a central draw stud and three peripheral draw studs may be used to secure the parts of the device.

The above configuration allows dismantling/assembly of the device 10 a plurality of times without causing any damage to the constructional parts of the device. This may facilitate repairing the device, if so needed, and may save work and materials needed therefor.

As described hereinabove, in some embodiments the magnetic core frames 12 are fabricated from silicon steel strips. In such applications, increased losses may incur in the magnetic core circuit 11, however, such implementations of the magnetic core 11 may be used in applications having reduced requirements in terms of effectiveness and efficiency of the magnetic induction device 10.

The winding of the frames 12 may be produced using a steel mandrel. In some embodiments the cross-section shape of the mandrel is rectangular, having geometrical dimensions of the internal window W12 of the magnetic core frames 12. For example, the thickness of the mandrel may be substantially equal to the width ($w_1$ in FIG. 3C) of the innermost multilayered step/loop $r_1$. The mechanical tension in the ribbon may be set according to the required winding density coefficient, which usually is about 0.8-0.9.

Computational simulation of a three-phase transformer fabricated according to the techniques of the present invention was performed, and the results were compared to those obtained using conventional three-phase transformers, having the planar "E+1" magnetic circuit structure made from silicon steel. The simulation was conducted for three-phase transformers designed for working powers of 630 kVA, primary voltages of 22 kV and secondary voltages of 400 V.

The simulation results indicate the advantageous feature of the three-phase transformer constructed using the techniques of the present invention, including inter alia the following features:

decrease of total weight by about 30-40%;
decrease of no-load losses in the range 72-84.6%;
decrease of load losses by 7-14%;
increase of efficiency of the device up to 99.2%; and
decrease in device volume by about 30-40%.

It is known that the amorphous ribbons have lower magnetic losses compared to silicon steel strips. Today, there exists some samples of power transformers of the "E+1" magnetic system configuration made of amorphous ribbons, such as, for example, type TE 790/10.1, BEZ Transformatory, Bratislava, Slovakia. Such transformers are relatively heavy (about 1.5 times heavier than the "E+1" transformers made of silicone steel strips), and have a relatively larger geometrical dimensions. However, the magnetic losses of these amorphous ribbon transformers are two times smaller than the magnetic losses of conventional silicone steel transformers, due to the use of an amorphous material.

It was found that power transformers in which the magnetic system is made of amorphous ribbons and having the structural features of the present invention (e.g., having a magnetic core constructed from three frames having a stair-stepped configuration on at least one face of the frames) has the following advantages compared to conventional amorphous high-power transformers:

Substantially reduced magnetic losses (no-load losses)—about two times less than the magnetic losses of conventional amorphous high-power transformers; and Substantially reduced weight of the transformer—the weight of the transformers of the present invention are about 1.8 times lighter i.e., reduction in transformer weight of about 55%.

Table 1 presents various parameters of three-phase transformers of the present invention in comparison to conventional three-phase transformers.

TABLE 1

(Parameters of transformer 630 kVa, 22 kV, dry, cast resin.)

| Firms | | | ARDAN Catalog | ABB Catalog | UTT toroid core* | Core of present invention |
|---|---|---|---|---|---|---|
| No | Name | Dim. | Parameters | Parameters | Parameters | Parameters |
| 1 | Power output | KVa | 630 | 630 | 630 | 630 |
| 2 | Frequency | Hz | 50 | 50 | 50 | 50 |
| 3 | Voltage primary | kV | 22 ± 2 × 2.5% | 22 ± 2 × 2.5% | 22 ± 2 × 2.5% | 22 ± 2 × 2.5% |
| 4 | Voltage secondary | V | 400 | 400 | 400 | 400 |
| 5 | Number of phases | | 3 | 3 | 3 | 3 |
| 6 | Diagram | | Δ/Yn-11 | Δ/Yn-11 | Δ/Yn-11 | Δ/Yn-11 |
| 7 | Type | | dtth | RESIBLOC | dry | dry |
| 8 | Power factor | | 1 | 1 | 1 | 1 |
| 9 | Efficiency | | 98.7 | 98.7 | 98.99 | 99.0 |
| 10 | Weight cores | Kg | | | 864 | 897 |
| 11 | Weight winding | Kg | | | 574 | 696 |
| 12 | Temperature of winding primary | ° C. | 75 | | 72 | 61 |
| 13 | Temperature of winding secondary | ° C. | 75 | | 75 | 69 |
| 14 | Losses no-load | W | 1380 | 1100 | 407 | 305 |
| 15 | Losses load for T = 75° C. | W | 6900 | 7100 | 5991 | 5987 |
| 16 | Insulation material | | Cast Resin | Cast Resin | Cast Resin | Cast Resin |
| 17 | Total weight (aprox.) | Kg | 2200 | 2700 | 1485 | 1645 |
| 18 | Height of transformer | mm | 1590 | 1900 | 1188 | 1515 |
| 19 | Length of transformer | mm | 1600 | 1710 | 880 | 920 |
| 20 | Width of transformer | mm | 820 | 1000 | 880 | 900 |

(*toroid core: based on transformer configuration described in U.S. Pat. No. U.S. Pat. No. 6,792,666)

The above examples and description have of course been provided only for the purpose of illustration, and are not intended to limit the invention in any way. As will be appreciated by the skilled person, the invention can be carried out in a great variety of ways, employing more than one technique from those described above, all without exceeding the scope of the invention.

The invention claimed is:

1. A magnetic core for a three-phase magnetic induction device, the magnetic core comprising three magnetic core frames forming magnetic core legs for mounting coils of the induction device thereover, each of the core frames being made from wound magnetic material ribbon, the magnetic core being characterized in that:

each of the core frames is constructed from a plurality of separate multilayered loops having a loop width different from the other loops in the frame;

each loop of the frame is separately made from wound magnetic material ribbon having a predefined ribbon width defining a thickness of the loop; and the multiple loops forming the frame are coaxially stacked one on top of the other such that stair-stepped configurations are formed along internal and external faces of the frame, the magnetic core frames are arranged in said magnetic core with the internal faces of the frames facing each other thereby forming a triangular prism structure, such that stair-stepped configuration of each frame become engaged with stair-stepped configurations of locally adjacent frames thereby forming three magnetic core legs of the magnetic core for mounting coils of said device thereover.

2. The magnetic core according to claim 1 wherein the multilayered loops are made from a material selected from a group consisting of: amorphous metal, amorphous alloy, and nanocrystalline alloy.

3. The magnetic core according to claim 2 wherein the width of the magnetic material ribbon is in the range of 10 to 20 mm.

4. The magnetic core according to claim 1 wherein cross sectional shape of leg and yoke portions of the frames is substantially right trapezoidal, such that cross sectional shape of the magnetic core legs obtained by engaging the stair-stepped configurations of the frames is substantially pentagon.

5. The magnetic core according to claim 1 wherein the multilayered loops are wound from magnetic material ribbons having same ribbon width, thereby defining substantially same thickness to each one of the loops and each one of the corresponding steps.

6. The magnetic core according to claim 1 wherein at least some of the multilayered loops are coaxially stacked one on top of the other in a descending order of their loop widths.

7. The magnetic core according to claim 1 wherein dimensions of the central loop openings of at least some of the loops are different, and wherein at least some of the multilayered loops are stacked one on top of the other in an ascending order of their loop widths with respect to the geometrical dimension of their central openings, and at least some of the multilayered loops are stacked one on top of the other in a descending order of their loop widths with respect to the geometrical dimension of their central loop openings, to thereby form a circular cross-sectional perimeter shape of the core legs obtained by engaging the stair-stepped configurations of locally adjacent frames.

8. The magnetic core according to claim 7 wherein the multilayered loops are made from magnetic ribbons having same ribbon width, and wherein a diameter of the core legs is determined by the following expression:

$$D'_{out} = \sqrt{\frac{4 \cdot K_2}{\pi} \cdot \left(S_{core} + 0.4 \cdot b_2 \cdot n_2 + 2\frac{b_2^2 \cdot n_2}{\cos 30°}\right)}$$

wherein $S_{core}$ is a calculated cross-sectional area of the magnetic core, $b_2$ is the ribbon width, $n_2$ is the number of multilayered loops in each frame, and $K_2$ is a coefficient determined based on a filling factor, or on a power factor, of the magnetic core.

9. The magnetic core according to claim 8 wherein the $K_2$ coefficient is in the range of 1.03 to 1.2.

10. A three-phase magnetic induction device comprising a magnetic core having three magnetic core frames configured to form magnetic core legs for mounting coils of the induction device thereover, each of the core frames being made from magnetic material ribbons, characterized in that:

each of the core frames is constructed from a plurality of separate multilayered loops having a loop width different from the other loops in the frame;

each loop of the frame is separately made from wound magnetic material ribbon having a predefined ribbon width defining a thickness of the loop;

the multiple loops forming the frame are coaxially stacked one on top of the other such that stair-stepped configurations are formed along internal and external faces of the frame; and the magnetic core frames are arranged in said magnetic core with the internal faces of the frames facing each other thereby forming a triangular prism structure, such that stair-stepped configuration of each frame become engaged with stair-stepped configurations of locally adjacent frames thereby forming three core legs.

11. The device according to claim 10 wherein cross-sectional shape of leg and yoke portions of the frames is substantially right trapezoidal such that cross-sectional shape of the core legs obtained by engaging the stair-stepped side portions of the frames is substantially pentagon.

12. The device according to claim 10 wherein the core legs have a circular cross-section perimeter shape.

13. The device according to claim 12 wherein the multilayered loops are made from magnetic ribbons having same ribbon width, and wherein a diameter of the core legs is determined by the following equation:

$$D'_{out} = \sqrt{\frac{4 \cdot K_2}{\pi} \cdot \left(S_{core} + 0.4 \cdot b_2 \cdot n_2 + 2\frac{b_2^2 \cdot n_2}{\cos 30°}\right)}$$

wherein $S_{core}$ is a calculated cross-sectional area of the magnetic core, $b_2$ is the ribbon width, $n_2$ is the number of multilayered loops in each frame, and $K_2$ is a coefficient determined based on a filling factor, or on a power factor, of the magnetic core.

14. A three-phase magnetic induction device comprising a magnetic core having three magnetic core frames configured to form magnetic core legs for mounting coils of the induction device thereover, characterized in that:

each of the core frames is constructed from a plurality of separate multilayered loops having a loop width different from the other loops in the frame;

each multilayered loop of the frame is separately made from wound amorphous metal ribbon having a predefined ribbon width defining a thickness of the loop; and the multilayered loops forming the frame are coaxially stacked one on top of the other such that stair-stepped configurations are formed along internal and external faces of the frame; and the magnetic core frames are arranged in said magnetic core with the internal faces of the frames facing each other thereby forming a triangular prism structure, such that stair-stepped configurations of each frame become engaged with stair-stepped configurations of locally adjacent frames thereby forming three core legs.

15. A method of constructing a magnetic core for a three-phase magnetic induction device, the method comprising preparing three magnetic core frames, placing said frames in said magnetic core with internal faces of the frames facing each other such that a triangular prism structure is formed, thereby forming three magnetic core legs for mounting coils of said device thereover, characterized in that:

each frame is constructed by coaxially stacking a plurality of multilayered loops one on top of the other with respect to their loop widths;

at least some of the loops having different loop widths such that stair-stepped configurations are formed along internal and external faces of said frame; and each multilayered loop is separately prepared from wound magnetic material ribbon, having a predefined ribbon width defining a thickness of the loop.

16. The method of claim 15 wherein preparing the multilayered loops comprises winding the magnetic material ribbon such that a predefined central loop opening is obtained in each one of said loops, the geometrical dimensions of the central loop openings of at least some of the loops are different, and wherein the stacking of the multilayered loops one on top of the other comprises stacking at least some of the multilayered loops in an ascending order of the widths of the loops and with respect to the geometrical dimension of their central openings, and stacking at least some of the multilayered loops one on top of the other in a descending order of their loop widths with respect to the geometrical dimension of their central loop openings, to thereby form a circular cross-sectional perimeter shape of the core legs obtained by engaging the stair-stepped configurations of locally adjacent frames.

17. The method according to claim 16 wherein the multilayered loops are made from magnetic ribbons having same ribbon width, the method further comprising determining a diameter of the core legs using the following equation:

$$D'_{out} = \sqrt{\frac{4 \cdot K_2}{\pi} \cdot \left(S_{core} + 0.4 \cdot b_2 \cdot n_2 + 2\frac{b_2^2 \cdot n_2}{\cos 30°}\right)}$$

wherein $S_{core}$ is a calculated cross-sectional area of the magnetic core, $b_2$ is the ribbon width, $n_2$ is the number of multi-layered loops in each frame, and $K_2$ is a coefficient determined based on a filling factor or a power factor of the magnetic core.

18. The method according to claim 15 comprising annealing the frames.

19. The method according to claim 15 comprising impregnating the frames in a binding material.

20. The method according to claim 15, comprising applying one or more layers of electrically insulating material between the engaged stair-stepped configurations of the locally adjacent frames.

21. The method according to claim 15, comprising:

transversally cutting each one of the frames into upper and bottom parts;

arranging the bottom parts of the frames to form a triangular prism structure by engaging the stair-stepped configurations of locally adjacent bottom parts of the frames to obtain three bottom leg portions of the core;

placing at least one coil over each one of the bottom leg portions; and attaching the upper portions of the frames over their respective bottom portions.

* * * * *